US006328420B1

(12) United States Patent
Koyama et al.

(10) Patent No.: US 6,328,420 B1
(45) Date of Patent: Dec. 11, 2001

(54) METHOD FOR MANUFACTURING AN ORIFICE PLATE FOR USE OF A LIQUID DISCHARGE, AN ORIFICE PLATE, A LIQUID DISCHARGE PROVIDED WITH SUCH ORIFICE PLATE, AND A METHOD FOR MANUFACTURING SUCH LIQUID DISCHARGE

(75) Inventors: Shuji Koyama; Kazuaki Masuda, both of Kawasaki; Ken Ikegame, Tokyo; Hiroaki Mihara, Musashino; Toshio Kashino, Chigasaki; Hiroyuki Ishinaga, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/110,025

(22) Filed: Jul. 2, 1998

(30) Foreign Application Priority Data

| | | |
|---|---|---|
| Jul. 3, 1997 | (JP) | 9-178292 |
| Aug. 26, 1997 | (JP) | 9-229653 |
| Jun. 25, 1998 | (JP) | 10-178817 |

(51) Int. Cl.[7] ..... B41J 2/135
(52) U.S. Cl. ..... 347/45; 347/47; 347/44
(58) Field of Search ..... 347/44, 45, 46, 347/47; 427/451, 452

(56) References Cited

U.S. PATENT DOCUMENTS

| | | | | |
|---|---|---|---|---|
| 2,650,900 | | 9/1953 | Holman . | |
| 4,595,937 | * | 6/1986 | Conta et al. | 347/22 |
| 5,182,577 | | 1/1993 | Ishinaga et al. . | |
| 5,277,783 | | 1/1994 | Ohashi et al. | 205/75 |
| 5,462,648 | | 10/1995 | Wakabayashi et al. | 205/75 |
| 5,760,803 | | 6/1998 | Yamamoto et al. | 347/47 |
| 6,126,269 | * | 10/2000 | Takemoto et al. | 347/45 |
| 6,151,049 | * | 11/2000 | Karita et al. | 347/65 |

FOREIGN PATENT DOCUMENTS

| | | | | |
|---|---|---|---|---|
| 0 273 552 A2 | | 7/1988 | (EP) . | |
| 0321075 | * | 6/1989 | (EP) | B41J/3/04 |
| 0 321 075 A2 | | 6/1989 | (EP) . | |
| 0 520 760 A1 | | 12/1992 | (EP) . | |
| 0 521 697 A2 | | 1/1993 | (EP) . | |
| 0 713 929 A1 | | 5/1996 | (EP) . | |
| 1 499 876 | | 2/1978 | (GB) . | |
| 61-59911 | | 3/1986 | (JP) . | |
| 61-59914 | | 3/1986 | (JP) . | |
| 63-297050 | | 12/1988 | (JP) . | |
| 63-309462 | | 12/1988 | (JP) . | |
| 11238733 | * | 8/1999 | (JP) | H01L/21/3205 |
| 11348289 | * | 12/1999 | (JP) | B41J/2/16 |

* cited by examiner

*Primary Examiner*—John Barlow
*Assistant Examiner*—Manish Shah
(74) *Attorney, Agent, or Firm*—Fitzpatrick, Cella, Harper & Scinto

(57) ABSTRACT

A method for manufacturing an orifice plate used for a liquid discharge provided with discharge port for discharging liquid comprises the steps of preparing a non-conductive plate having recessed portion formed on the circumference of the flat portion corresponding to the discharge port, forming a first conductive material peelable from the non-conductive plate only in the recessed portion of the non-conductive plate, forming a plate member by plating the first conductive material with a second conductive material by electroforming method after the formation of the first conductive material, and obtaining the orifice plate having the discharge port by peeling off the plate member from the non-conductive plate. With the method thus arranged, it is possible to materialize the same precision as in the glass mask used for photolithography, and make the variation of orifice areas smaller for the formation of highly densified orifices.

27 Claims, 19 Drawing Sheets

METHOD FOR MANUFACTURING AN ORIFICE PLATE FOR USE OF A LIQUID DISCHARGE, AN ORIFICE PLATE, A LIQUID DISCHARGE PROVIDED WITH SUCH ORIFICE PLATE, AND A METHOD FOR MANUFACTURING SUCH LIQUID DISCHARGE

BACKGROUND OF THE INVENTION

1. Field of the Invention

The present invention relates to a method for manufacturing an orifice plate for use of a liquid discharge that discharges a desired liquid by the creation of bubbles generated by the application of thermal energy or the like. It also relates to an orifice plate manufactured by such method of manufacture, a method for manufacturing a liquid discharge provided with such orifice plate, and a liquid discharge manufactured by such method of manufacture. The present invention is applicable to a printer, a copying machine, a facsimile equipment provided with communication system, a word processor provided with a printing unit, and some other apparatuses. It also applicable to an industrial recording system having various processing apparatuses combined comlexly therefor to make it possible to record on a recording medium, such as paper, thread, fiber, cloths, leather, metal, plastic, glass, wood, ceramic, or the like.

Here, for the present invention, the term "recording" referred to in the specification hereof means not only the provision of characters, graphics, or some other images that present some meaning when recorded on a recording medium, but also, means the provision of images that do not present any particular meaning, such as patterns recorded on the recording medium.

2. Related Background Art

There has been known conventionally a bubble jet recording method whereby to provide ink with heat or some other energy generated to cause its states to be changed with the abrupt voluminal changes in ink (the creation of bubbles) so that ink is discharged from a discharge port on the basis of acting force exerted by such change of states, thus forming images on a recording medium by the adhesion of ink to it. The recording apparatus that use this bubble jet recording method is generally provided with the ink discharge port for discharging ink; the ink flow path communicated with the discharge port, and heat generating devices (electrothermal converting devices) serving as energy generating means for discharging ink distributed in each of the ink flow paths as disclosed in the specifications of Japanese Patent Publication No. 61-59911 and Japanese Patent Publication No. 61-59914, among some others. In accordance with this recording method, it is possible to record high quality images at high speeds in a lesser amount of noises. At the same time, it is possible to arrange the ink discharge port in high density for the head that adopts this recording method. Therefore, images can be recorded in high resolution by use of a smaller apparatus, while making it easier to obtain color images, among many other advantages. As a result, the bubble jet recording method has been widely used for office equipment, such as a printer, a copying machine, or a facsimile equipment in recent years. This method has been utilized also for a textile printing apparatus, and other industrial recording systems as well.

Along with the utilization of bubble jet technologies and techniques in the various fields of application, there has been a strong demand on the provision of a recording apparatus which is capable of recording in higher resolution at lower costs.

Here, the ink discharge port are formed on an orifice plate. Usually, however, the orifice plate is adhesively bonded to the liquid discharge main body side by the application of adhesive or the like subsequent to the discharge port having been formed on it.

Now, hereunder, the detailed description will be made of the conventional method for manufacturing an orifice plate.

FIGS. 17A to 17C are views which illustrate the steps of manufacture in accordance with the conventional method for manufacturing an orifice plate.

At first, using the photolithographing method the resist 307 is formed in a specific position on the substrate 301 (FIG. 17A).

Then, on the substrate 301 having the resist 307 formed on it, nickel 308 is formed by use of electroforming (FIG. 17B).

After that, the resist 307 and the substrate 301 are peeled off from the nickel 308 one after another in that order in order to form the discharge port 302 (FIG. 17C).

Also, there is a method for manufacturing an orifice plate with resin instead of using the electroforming method described above.

Of the liquid discharges manufactured by use of these methods, there is the one whose printing reliability has been enhanced by trapping ink adhering to the face by a face pattern (the discharge opening surface having the water-repellent pattern on the circumference of the surface of the discharge port and the hydrophilic pattern on the portion away from the circumference thereof). Here, the face pattern of the kind is obtainable by the irradiation of excimer laser on the resin sheet.

However, in accordance with the conventional method, the resist is formed in advance on the portion where the discharge port is formed, and then, by use of the electroforming, nickel is formed in order to provide the orifice plate. After that, the discharge port are formed by peeling off the resist from the nickel. As a result, the step 310 is inevitably formed on the discharge port as shown in FIG. 17C. This formation of such step 310 is not desirable for the performance of effective ink discharges.

More specifically, if any ink which has increased viscosity should adhere due to the presence of this step, it is made difficult for the discharge energy to act upon the discharge of droplets effectively or if the configuration of each of such steps should vary, the discharge directivity is allowed to vary accordingly.

Here, the corner portion 311 formed by the step 310 makes it easier for discharging droplets to reside on that portion to cause the loss of discharge energy accordingly.

Also, when the hydrophilic pattern is formed by the application of laser, a problem is encountered that this formation makes it difficult to arrange the position of orifices in a sufficiently high precision.

Here, with a view to enhancing the abrasion resistance and durability of the orifice plate described above, it is desirable to use Ni or other metallic material for the orifice plate.

However, if the portion on the elemental substrate having the orifice plate, the ceiling plate, and the heaters arranged on it, which is in contact with ink, should be formed by metal or some other conductive material from the viewpoint of its manufacture, the liquid discharge and such portion become electrically conductive through ink (by the direct contact or through the adhesive) to present a cell structure which may in some cases satisfy the condition that allows electrolytic corrosion to occur.

If the orifice plate is left intact under such condition, the orifices on the orifice plate are dissolved to change the area of the orifice surface. Conceivably, therefore, the amount of discharges is made inconstant.

With a view to dealing with such condition as described above, the inventors hereof have taken up as one of the new subjects that the reliability of the orifice plate should be made invariable and more stabilized for a longer period.

Also, in consideration of each of the materials used for the inner structure of the liquid flow paths of a liquid discharge provided with the orifice plate, including, of course, its surface to be in contact with liquid as well as the external layer portions thereof, it is assumed that, in some cases, the inner structure may become electrically conductive, not necessarily directly as described above, but depending on the components contained in the liquid. In other words, the condition of electrolytic corrosion may be satisfied depending on some metallic ion or other ion contained in the liquid as the case may be. An ion of the kind may inevitably exist in the liquid flow paths due to the structure of liquid container serving as the supply-source of liquid or due to the unprepared supply of liquid other than the designated one. Therefore, it becomes a second subject to be taken up by the inventors hereof that even in such a case as described above, the reliability of the orifice plate should be made invariable and stabilized for a longer period.

SUMMARY OF THE INVENTION

Taking these subjects into consideration, the present invention is designed. It is an object of the invention to provide a method for manufacturing an orifice plate capable of discharging liquid droplets stably, while materializing the provision of high quality images, as well as presenting the chemical stability thereof even when electroforming is used, and also, to provide an orifice plate manufactured by such method of manufacture, a method for manufacturing a liquid discharge having such orifice plate therefor, and a liquid discharge manufactured by such method of manufacture as well.

In order to achieve these objects, the method of the present invention for manufacturing an orifice plate used for a liquid discharge provided with discharge port for discharging liquid comprises the following steps of:

- preparing a non-conductive plate having recessed portion formed on the circumference of the flat portion corresponding to the discharge port;
- forming a first conductive material peelable from the non-conductive plate only in the recessed portion of the non-conductive plate;
- forming a plate member by plating the first conductive material with a second conductive material by electroforming method after the formation of the first conductive material; and
- obtaining the orifice plate having the discharge port by peeling off the plate member from the non-conductive plate.

Also, the orifice plate of the present invention used for a liquid discharge having discharge port for discharging liquid, which is formed by nickel, is provided with a protection layer having a higher resistance to corrosion than nickel being formed on the surface of the orifice plate on the ink discharge side.

Also, a method of the present invention for manufacturing a liquid discharge provided with a plurality of discharge port for discharging liquid, an orifice plate provided with the discharge port, a plurality of liquid flow paths conductively connected with the discharge port, a plurality of energy generating devices arranged for the liquid flow paths to generate energy to be utilized for discharging liquid, and a substrate provided with the energy generating devices, comprises the following steps of:

- preparing a non-conductive plate having recessed portion formed on the circumference of the flat portion corresponding to the discharge port;
- forming a first conductive material peelable from the non-conductive plate only in the recessed portion of the non-conductive plate;
- forming a plate member becoming an orifice plate by plating the first conductive material with a second conductive material by electroforming method after the formation of the first conductive material;
- positioning with the plate member the substrate having grooves thereon to serve as the liquid flow paths, and bonding the plate and the substrate together; and
- peeling off the bonded body of the plate member and the substrate from the non-conductive plate.

With the present invention structured as described above, the glass grooves are patterned with the chromium which is electron bean etched on the glass plate as the mask, and plating is made with silver being buried in the glass grooves. In this way, the orifice plate is formed, thus making it possible to materialize the same precision as in the case of adoption of the glass mask used for photolithography. Therefore, the variation of the orifice areas is made smaller to make the highly densified formation of orifices possible.

Also, since the discharge port are formed without using resist, there is no possibility that any step is formed with respect to the discharge port. Therefore, it becomes possible to avoid any difficulty that may hinder the effectiveness of discharge energy acting upon discharging liquid droplets or to prevent the discharge directivity from being varied.

Also, the photolithographing steps are not adopted in order to manufacture orifice plates at lower costs. At the same time, there is no optical interference that may result in the elliptical configuration of each discharge opening. There is no resist wall present, either, when plating is made. As a result, the sectional configuration of the discharge port shows the slanted form to make it easier to hold meniscus for the implementation of more stabilized liquid discharges and the enhancement of refilling capability as well. Also, there are no sharp edges existing on the surface of the orifice plate, hence making it possible to enhance the durability of blade, and form a structure that makes it easier to trap liquid.

Also, the chromium, which is electron-beam etched on the glass plate, is used as the mask to pattern the glass grooves. Then, after the glass grooves are nickel plated with silver being buried in them, the nickel is further plated with a coating material having a higher resistant to corrosion than the nickel. As a result, even if silicon or metal is used for the elemental substrate provided with heater members on it, and the ceiling plate provided with flow paths formed for it, there is no possibility that the orifice plate is dissolved due to the formation of the cell reaction.

Also, the resist pattern is formed on the matrix, and after being nickel plated, the nickel is peeled off from the matrix. Then, on the surface on the matrix side, the protection layer is formed with the material having a higher resistance to corrosion than the nickel. In this case, too, it is possible to obtain the same effect as described above, hence presenting no possibility that the orifice plate is dissolved due to the cell structure.

BRIEF DESCRIPTION OF THE DRAWINGS

FIGS. 1A, 1B, 1C, 1D and 1E are plan views, and FIGS. 1F, 1G, 1H, 1I and 1J are cross-sectional views, taken along lines 1F—1F to 1J—1J; and FIG. 1K and FIG. 1L are partially enlarged views, respectively.

FIG. 5A is a perspective view which shows the external appearance thereof; FIG. 5B is a partially enlarged view which shows the portion 5B in FIG. 5A; FIG. 5C is a cross-sectional view, taken along line 5C—5C in FIG. 5B; FIG. 5D is a partially enlarged view which shows the portion 5D in FIG. 5C.

FIGS. 8A, 8B, 8C, 8D and 8E are plan views, and FIGS. 8F, 8G, 8H, 8I and 8J are cross-sectional views, taken along lines 8F—8F to 8J—8J; and FIG. 8K and FIG. 8L are partially enlarged views, respectively.

FIG. 10A is a perspective view which shows the external appearance thereof; FIG. 10B is a partially enlarged view which shows the portion 10B in FIG. 10A; FIG. 10C is a cross-sectional view, taken along line 10C—10C in FIG. 10B; FIG. 10D is a partially enlarged view which shows the portion 10D in FIG. 10C.

FIGS. 12A, 12B and 12C are plan views; FIGS. 12D, 12E and 12F are cross-sectional views, taken along lines 12D—12D to 12F—12F, respectively.

FIG. 13A is a perspective view which shows the external appearance; FIG. 13B is a partially enlarged view which shows the portion 13B in FIG. 13A; and FIG. 13C is a cross-sectional view, taken along line 13C—13C.

DETAILED DESCRIPTION OF THE PREFERRED EMBODIMENTS

Hereinafter, with reference to the accompanying drawings, the embodiments will be described in accordance with the present invention.

(Embodiment 1)

Figure 1A:
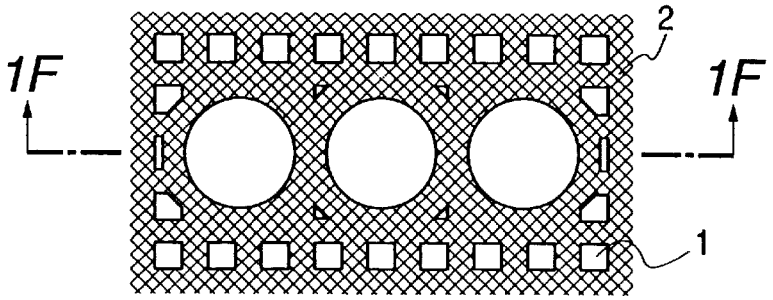
FIGS. 1A, 1B, 1C, 1D, 1E, 1F, 1G, 1H, 1I, 1J, 1K and 1L are views which illustrate each of the steps of a method for manufacturing an orifice plate in accordance with one embodiment of the present invention.
Figure 1B:
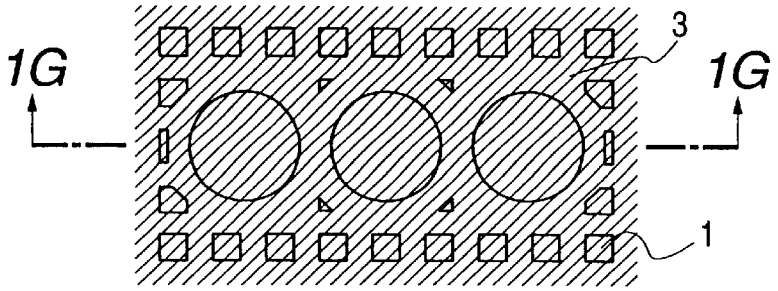
Figure 1C:
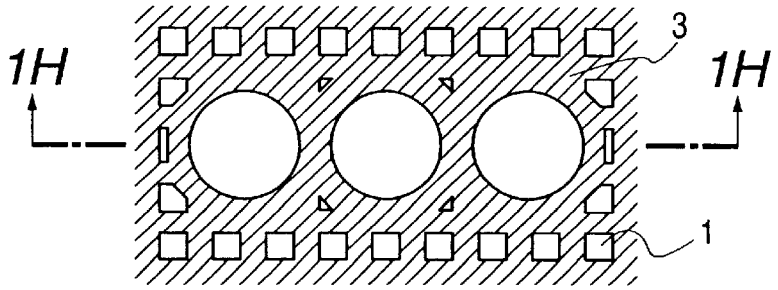
Figure 1D:
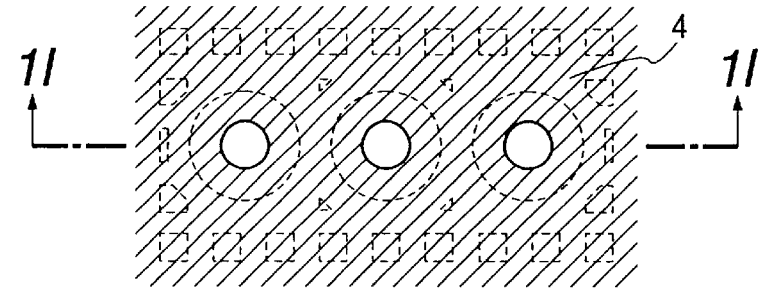
Figure 1E:
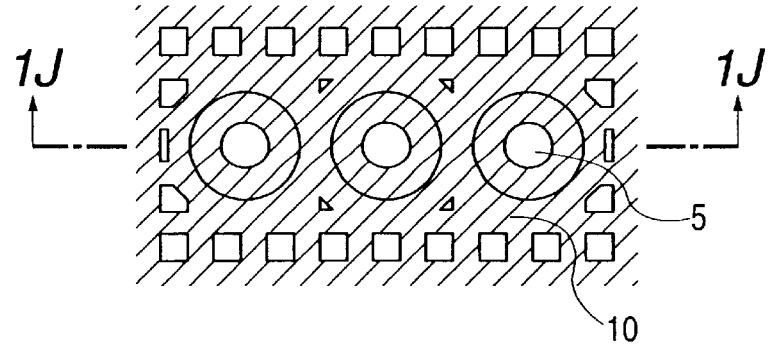
Figure 1F:
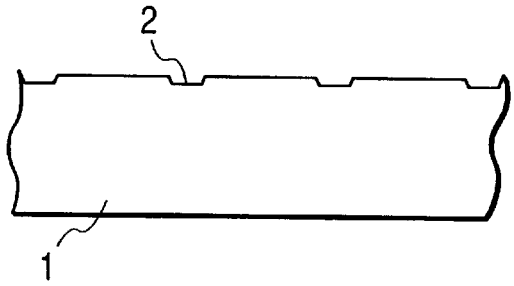
Figure 1G:
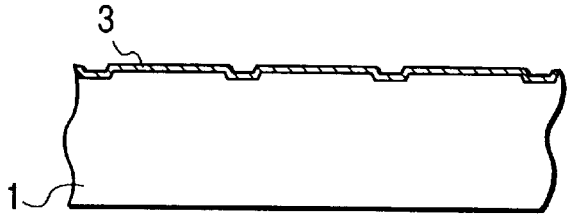
Figure 1K:
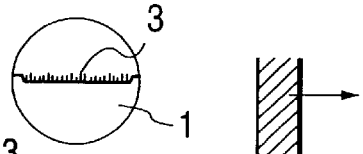
Figure 1H:
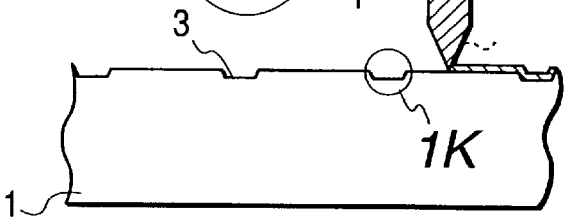
Figure 1I:
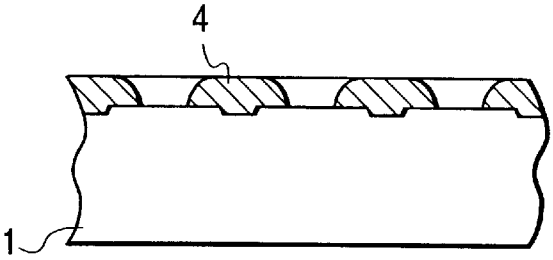
Figure 1L:
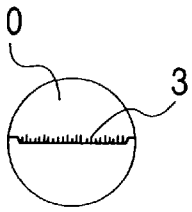

FIGS. 1A to 1L are views which illustrate each of the steps of a method for manufacturing an orifice plate in accordance with one embodiment of the present invention; FIGS. 1A to 1E are plan views, and FIGS. 1F to 1J are cross-sectional views, taken along lines IF—IF to 1J—1J; and FIG. 1K and FIG. 1L are partially enlarged views, respectively.

Here, in accordance with the present embodiment, the silver mirror reaction occurs on the glass plate on which the pattern grooves of an orifice plate are patterned in high precision. Then, nickel is plated subsequent to rubbing off silver into the patterned grooved on the glass plate so that silver remains in them, hence manufacturing the orifice plate. By the present embodiment, it is exemplified that the orifice plate thus manufactured is bonded to the liquid discharge of the edge shooter type.

At first, in the same procedures as those required for producing a photomask, chromium is filmed on the glass, and resist is patterned by means of the EB etching. Then, chromium is etched to produce the chrome pattern. With chromium as mask, glass is etched to form the patterned grooves of an orifice plate. In this way, the glass plate 1 is produced (FIGS. 1A and 1F).

After the glass plate 1 has been produced, the silver mirror reaction is effectuated over the entire surface to film silver 3 (FIGS. 1B and 1G).

Subsequently, by use of a sponge, silver is rubbed off so that silver remains in the patterned grooves (recessed portion) of the glass plate 1. Here, since the patterned grooves 2 are formed on the glass plate 1, silver 3 is allowed to remain only in the patterned grooves 2 of the orifice plate when silver residing on the surface is rubbed off (FIGS. 1C and 1H). Here, the surface of silver 3 is rough as shown in FIG. 1H.

Then, by use of the electroforming, nickel 4 is developed in a thickness of 10 $\mu$m on the portions where silver 3 remain to make the nickel plating (FIGS. 1D and 1I).

Figure 1J:
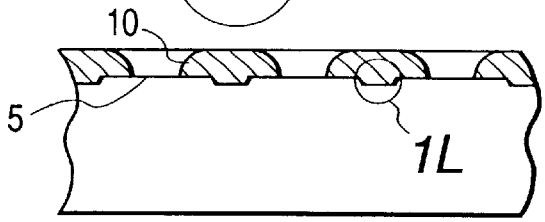

After that, the nickel 4 plated orifice plate 10 is peeled off from the glass plate 1 to complete the orifice plate 10 (FIGS. 1E and 1J). Here, at this juncture, the diameter of the discharge port thus formed is 16 $\mu$m±3%.

Now, the detailed description will be made of the method for plating nickel 4 as described above.

Figure 2:
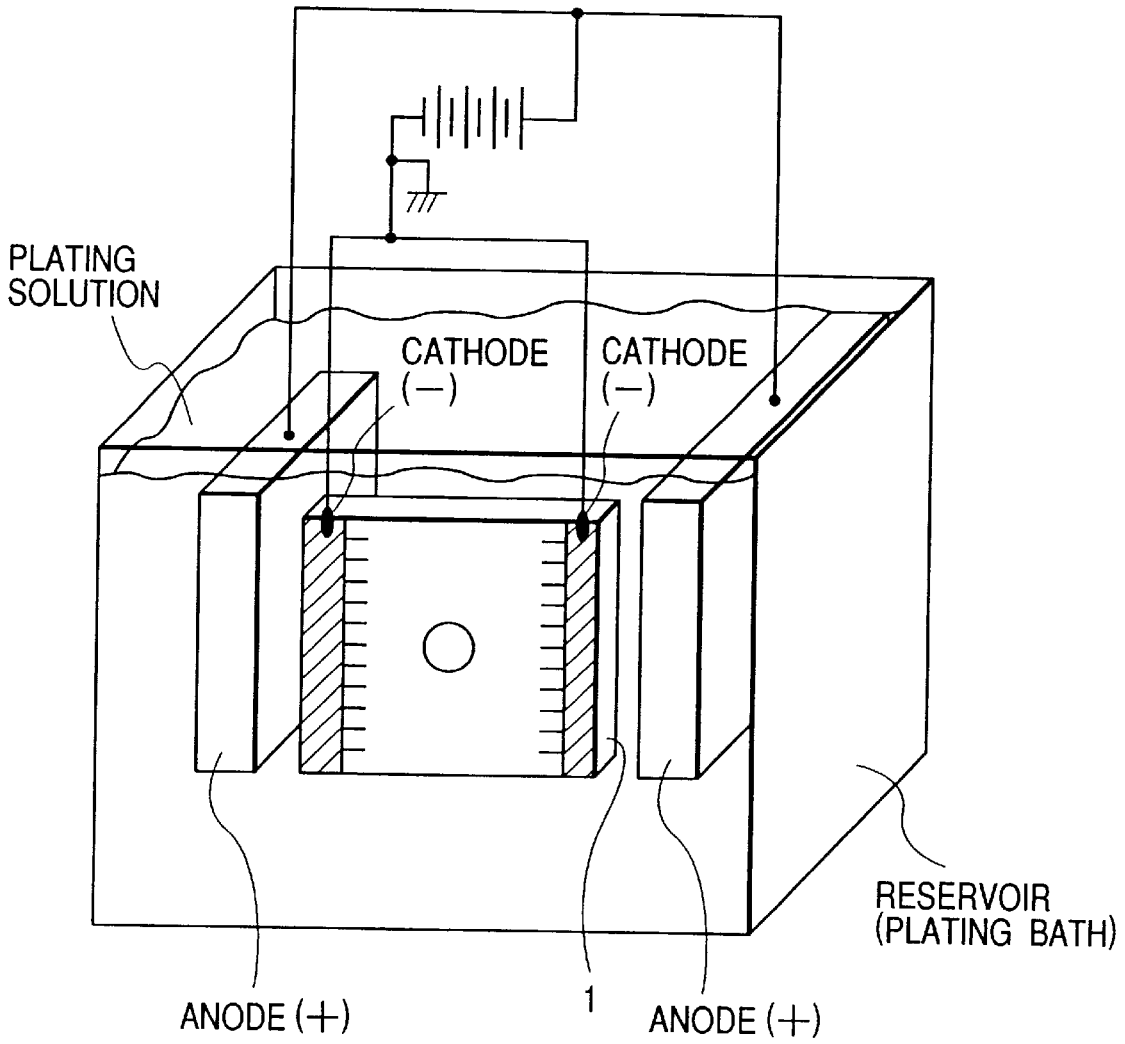
FIG. 2 is a perspective view which shows an apparatus used for the plating step in the method for manufacturing an orifice plate represented in FIGS. 1A, 1B, 1C, 1D, 1E, 1F, 1G, 1H, 1I, 1J, 1K and 1L.

FIG. 2 is a perspective view which shows an apparatus used for the plating process of the method for manufacturing an orifice plate represented in FIGS. 1A to 1L.

As the plating solution, nickel sulfamate is used together with an applied reducer, zeol (manufactured by the World Metal K.K.), boric acid, a pit inhibitor, NS-APS (manufactured by the World Metal K.K.), and nickel chloride.

For the electrodeposition, the electric field is applied in such a manner that the electrodes are connected on the anode side in the plating solution, while the electrodes having silver 3 formed thereon are connected on the cathode side. The plating temperature is 50° C. The current density is 5 A/dm$^2$.

In this respect, the portion indicated by slanted lines in FIG. 1C is the electrode unit to which the cathode is connected.

In accordance with the present embodiment, nickel is plated. Besides, however, it may be possible to plate the silver portion 3 with gold, palladium, platinum, chromium, nickel-cobalt alloy, or nickel-palladium alloy.

Figure 3:
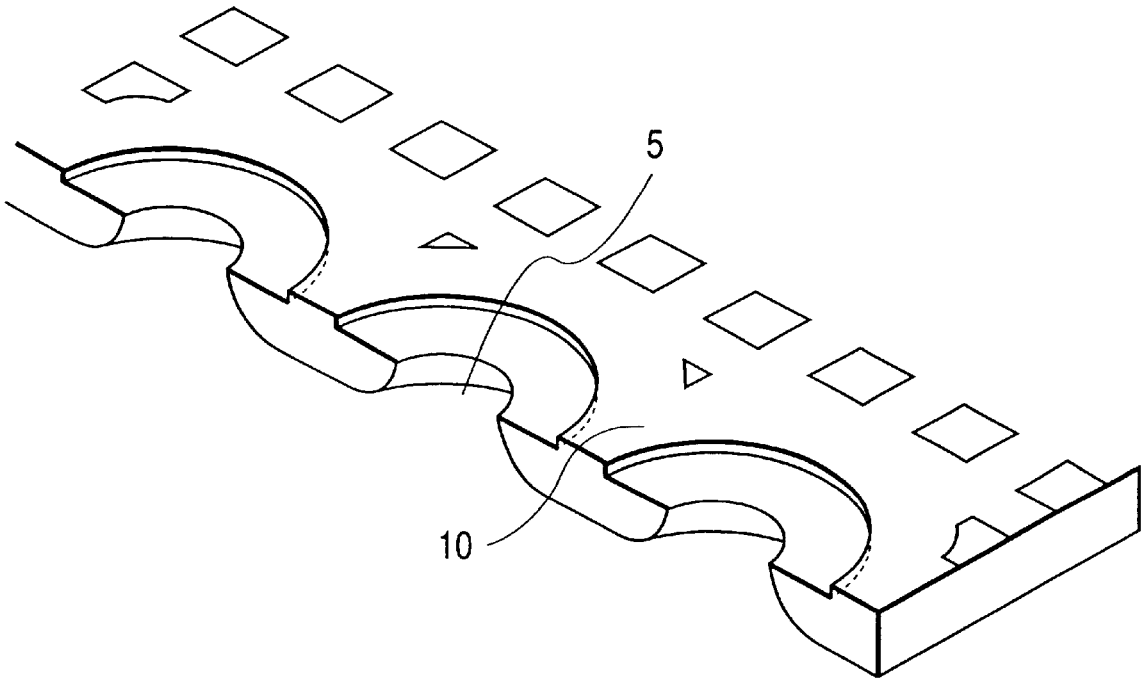
FIG. 3 is a perspective view which shows the external appearance of configuration of the orifice plate manufactured by the method represented in FIGS. 1A, 1B, 1C, 1D, 1E, 1F, 1G, 1H, 1I, 1J, 1K and 1L.

FIG. 3 is a perspective view which shows the external appearance of the orifice plate manufactured by the method represented in FIGS. 1A to 1L.

Since no resist is used for the method of manufacture shown in FIGS. 1A to 1L, nickel is allowed to be developed isotropically so that its section becomes to represent the rounded form as shown in FIG. 3.

Figure 4:
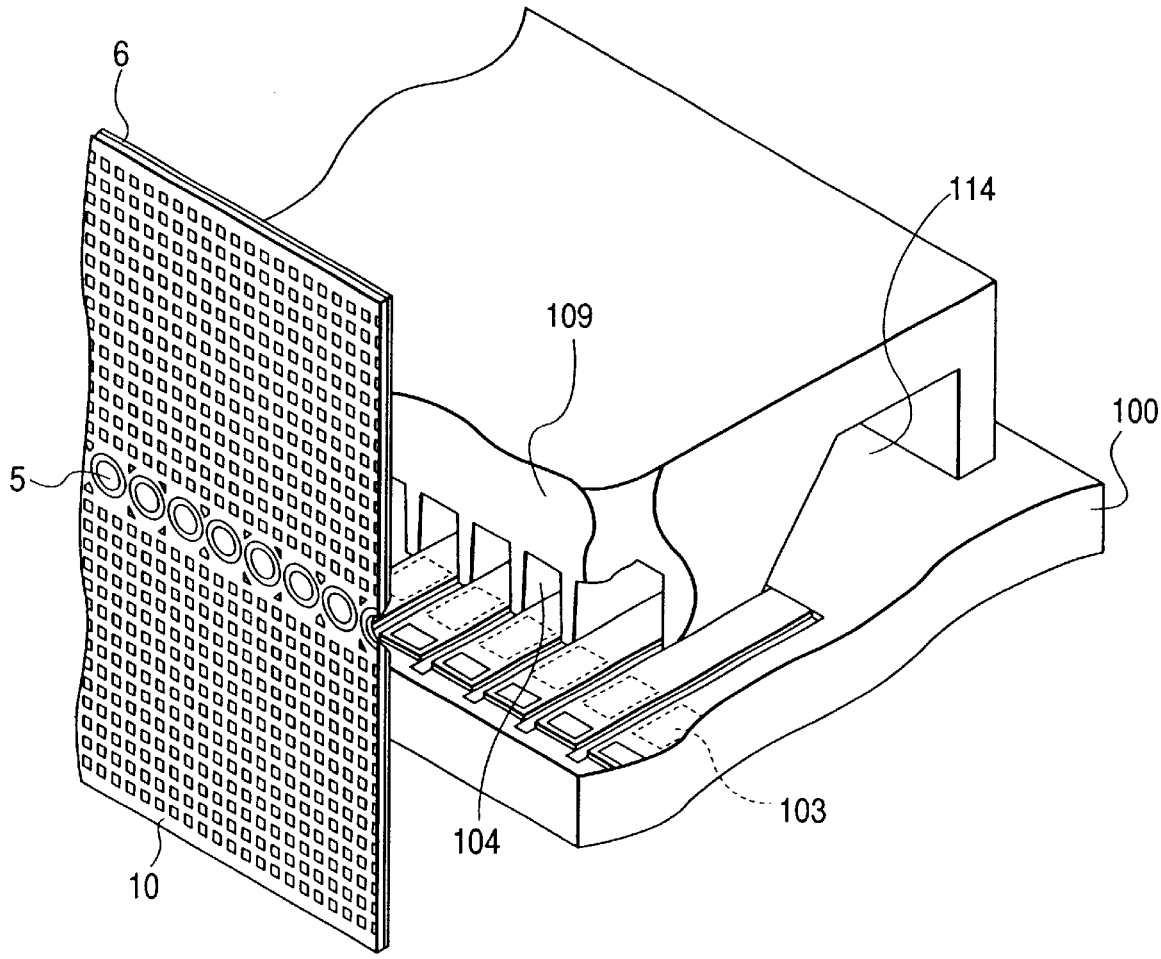
FIG. 4 is a view which shows one assembling step of the orifice plate, which is manufactured by the method represented in FIGS. 1A, 1B, 1C, 1D, 1E, 1F, 1G, 1H, 1I, 1J, 1K and 1L, to a liquid discharge.

FIG. 4 is a view which shows one assembling step of the orifice plate, which is manufactured by the method represented in FIGS. 1A to 1L, to a liquid discharge.

As shown in FIG. 4, adhesive 6 is coated on the orifice plate 10. Then, the orifice plate 10 having the adhesive 6 coated thereon is bonded to the face surface of the liquid discharge having the liquid flow paths 104, the elemental substrate 100 provided with the heating member 103, and the ceiling plate 109 formed for the head.

Figure 5A:
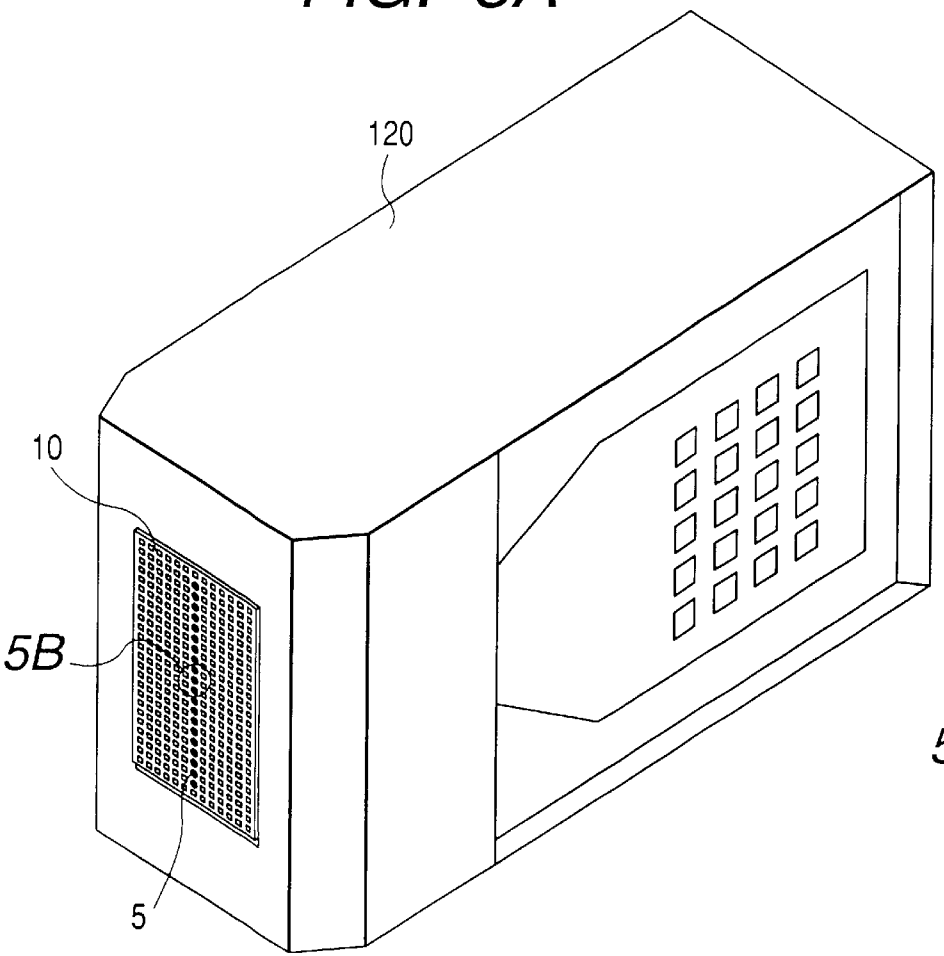
FIGS. 5A, 5B, 5C and 5D are views which illustrate the configuration of the liquid discharge provided with the orifice plate manufactured by the method represented in FIGS. 1A, 1B, 1C, 11D, 1E, 1F, 1G, 1H, 1I, 1J, 1K and 1L.
Figure 5B:
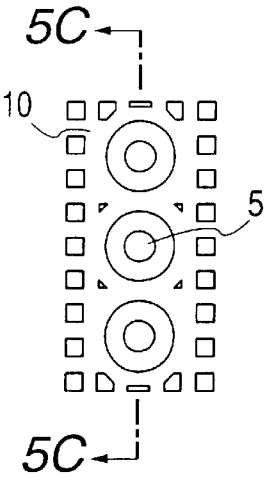
Figure 5C:
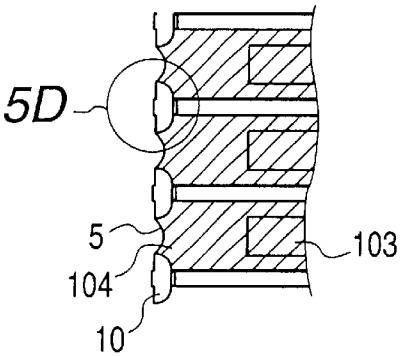
Figure 5D:
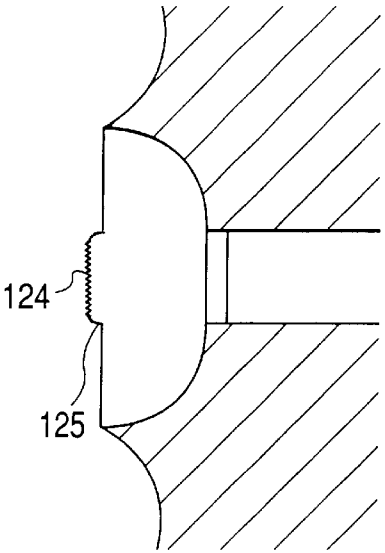

FIGS. 5A to 5D are views which illustrate the configuration of the liquid discharge provided with the orifice plate manufactured by the method represented in FIGS. 1A to 1L; FIG. 5A is a perspective view which shows the external appearance thereof; FIG. 5B is a partially enlarged view which shows the portion 5B in FIG. 5A; FIG. 5C is a cross-sectional view, taken along line 5C—5C in FIG. 5B; FIG. 5D is a partially enlarged view which shows the portion 5D in FIG. 5C.

In the processing step shown in FIG. 4, the orifice plate 10 is bonded to the face surface of the liquid discharge. After that, the assembled body is incorporated in an ink cartridge 120. Thus, as shown in FIGS. 5A to 5D, the liquid discharge is completed.

Here, in accordance with the present embodiment, the edge of the pattern 124, having discharge port being formed in a specific position on the orifice plate as shown in FIG. 5D, becomes a rounded form 125 when the edge near the discharge port is lost at the time of distribution and in the initial stage of use. At the same time, the surface becomes irregular.

This formation is made when the face is wiped by the blade for removing dust particles and ink adhering to the face as well. Also, the adhesion of ink may encroach on the face to result in such formation.

In this way, it becomes possible to prevent the blade from being cut off by the sharp edged pattern of the face, and to prevent the blade from being deteriorated. Also, with the irregularities formed on the surface, the hydrophilic property of this portion becomes extremely higher than the other portions, thus making it possible to trap ink on them.

Further, since the pattern 124, which is provided with the hydrophilic property, is continuously arranged, it becomes possible to provide a wider area serving as the ink trapping region and enhance the ink trapping capability accordingly, while making it difficult for the ink, which adheres to the face surface, to enter the discharge port.

(Embodiment 2)

For the embodiment described above, the description has been made of the example in which an orifice plate is applied to a head of the edge shooter type. However, it is also possible to apply the orifice plate to a head of the side shooter type.

Figure 6:
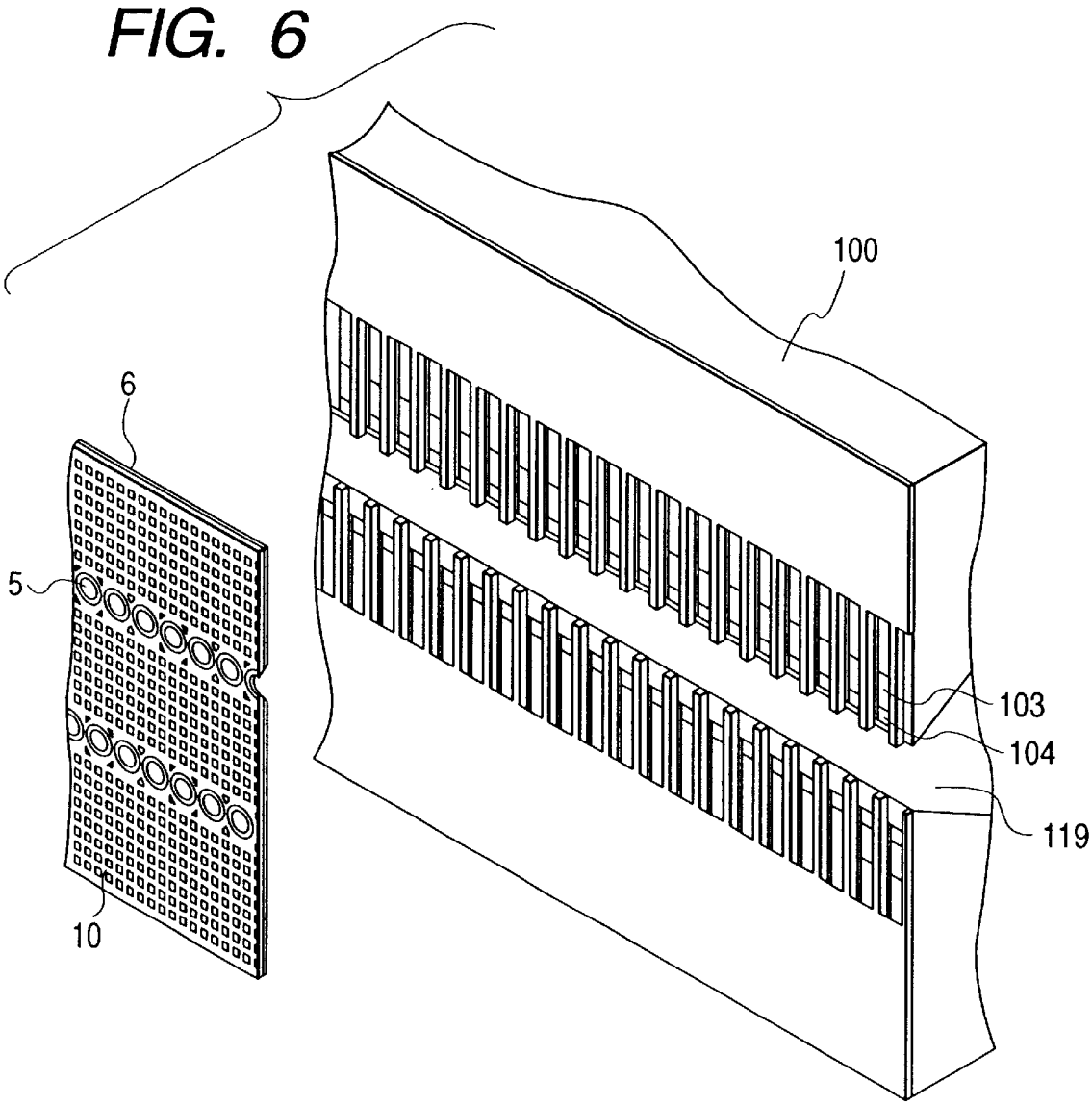
FIG. 6 is a view which shows one assembling step of the orifice plate, which is manufactured by the method represented in FIGS. 1A, 1B, 1C, 1D, 1E, 1F, 1G, 1H, 1I, 1J, 1K and 1L, to a liquid discharge of the side shooter type.
Figure 7:
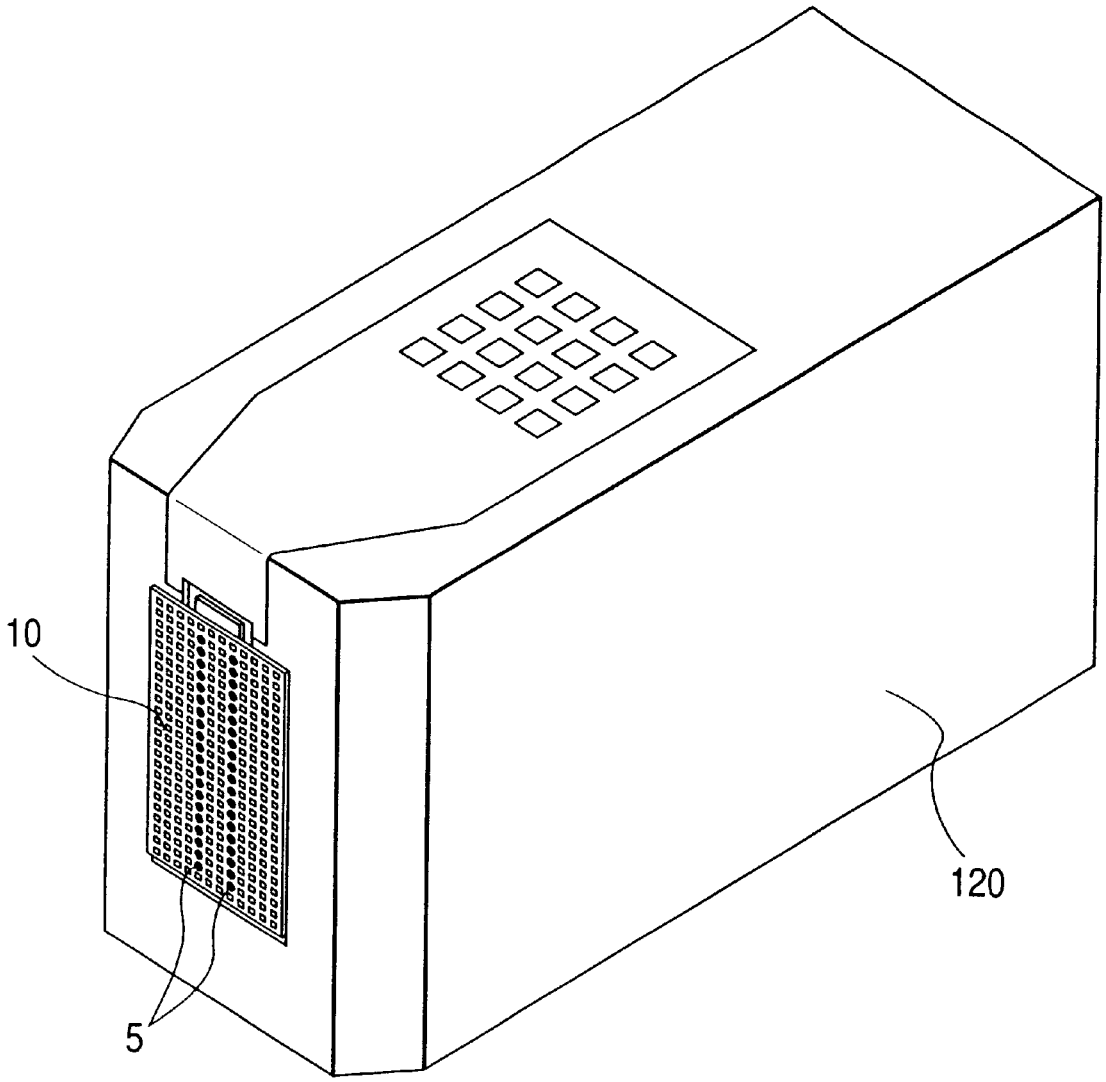
FIG. 7 is a views which shows the configuration of the liquid discharge of the side shooter type provided with the orifice plate manufactured by the method represented in FIGS. 1A, 1B, 1C, 1D, 1E, 1F, 1G, 1H, 1I, 1J, 1K and 1L.

FIG. 6 is a view which shows one assembling step of the orifice plate, which is manufactured by the method represented in FIGS. 1A to 1L, to a liquid discharge of the side shooter type. FIG. 7 is a view which shows the configuration of the liquid discharge of the side shooter type provided with the orifice plate manufactured by the method represented in FIGS. 1A to 1L.

As shown in FIG. 6, the adhesive 6 is coated on the orifice plate 10. Then, the orifice plate 10 having the discharge port 5 arranged therefor is bonded to the liquid discharge provided with the liquid flow paths 104, the elemental substrate 100, and the ink supply path 119.

After the orifice plate has been bonded to the liquid discharge, it is incorporated in an ink cartridge 120 as shown in FIG. 7, thus completing the liquid discharge.

Here, in accordance with the embodiment described above, the adhesive is coated on the orifice plate side when it is bonded to the liquid discharge. However, it may be possible to coat the adhesive on the face surface side for the liquid discharge shown in FIG. 4 or on the elemental substrate 100 side for the liquid discharge shown in FIG. 6. As the adhesive, the two-part adhesive which is an epoxy adhesive (CS-2340-5: manufactured by the Cemedain K.K.) or the polyether amide adhesive (HIMAL: manufactured by Hitachi Kasei K.K.) is used.

(Embodiment 3)

Figure 8A:
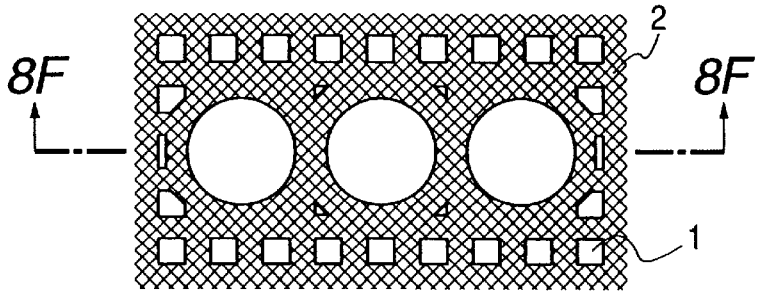
FIGS. 8A, 8B, 8C, 8D, 8E, 8F, 8G, 8H, 8I, 8J, 8K and 8L are views which illustrate each of the steps of a method for manufacturing an orifice plate in accordance with one embodiment of the present invention.
Figure 8B:
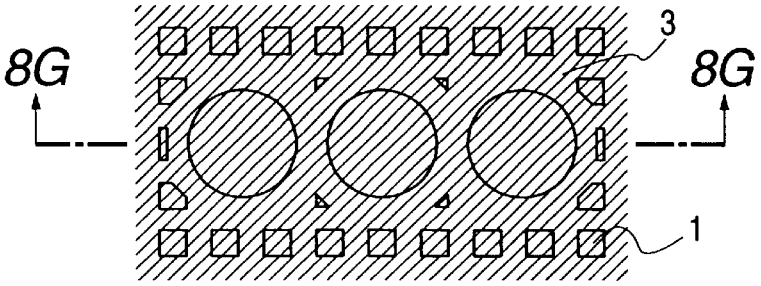
Figure 8C:
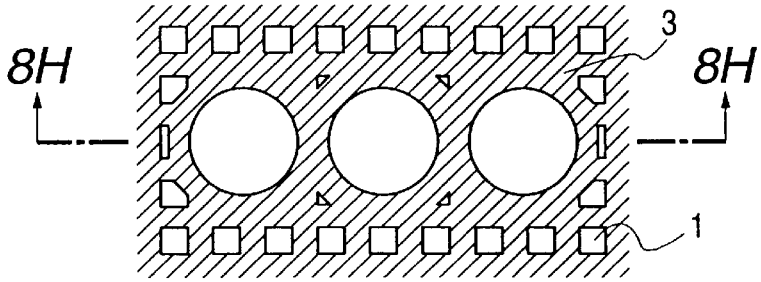
Figure 8D:
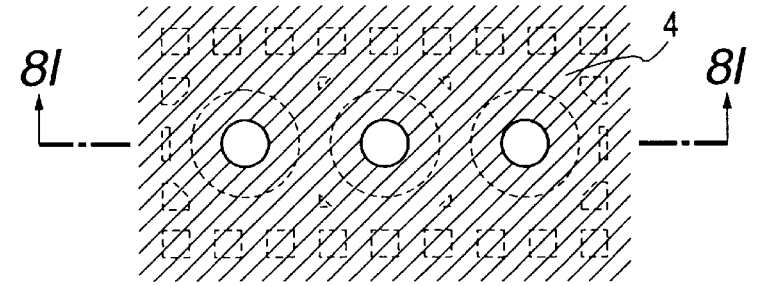
Figure 8E:
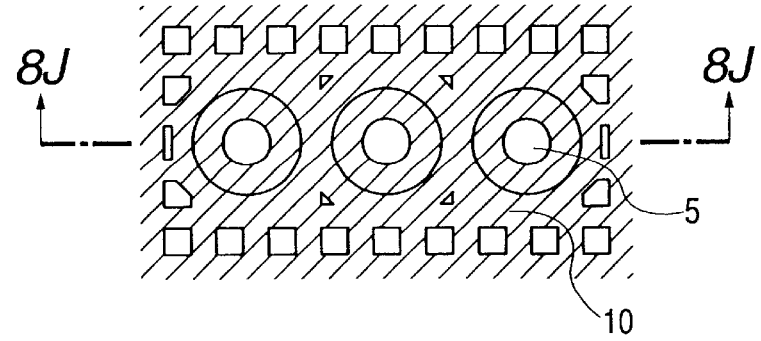
Figure 8F:
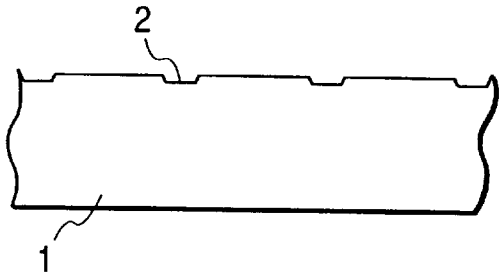
Figure 8G:
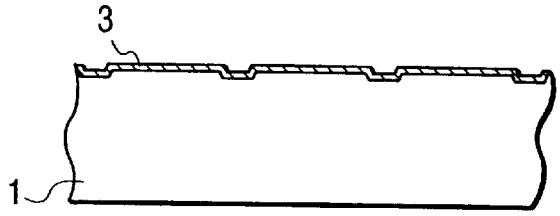
Figure 8K:
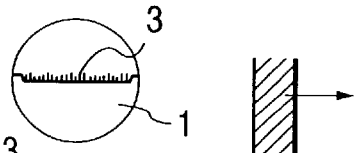
Figure 8H:
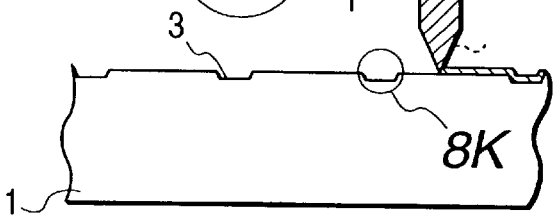
Figure 8I:
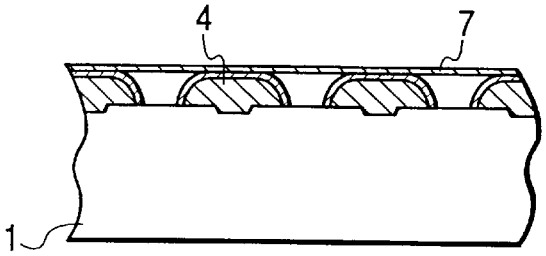
Figure 8L:
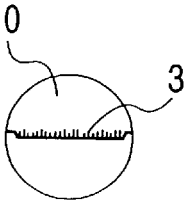

FIGS. 8A to 8L are views which illustrate each of the steps of a method for manufacturing an orifice plate in accordance with one embodiment of the present invention; FIGS. 8A to 8E are plan views, and FIGS. 8F to 8J are cross-sectional views, taken along lines 8F—8F to 8J—8J; and FIG. 8K and FIG. 8L are partially enlarged views, respectively.

Here, in accordance with the present embodiment, the silver mirror reaction occurs on the glass plate on which the pattern grooves of an orifice plate are patterned in high precision. Then, nickel is plated subsequent to rubbing off silver into the patterned grooved on the glass plate so that silver remains in them, thus manufacturing the orifice plate. By the present embodiment, it is exemplified that the orifice plate thus manufactured is bonded to the liquid discharge of the edge shooter type.

At first, in the same procedures as those required for preparing a photomask, chromium is filmed on the glass, and resist is patterned by means of the EB etching. Then, chromium is etched to produce the chrome pattern. With chromium as mask, glass is etched to form the patterned grooves 2 of an orifice plate. In this way, the glass plate 1 is produced (FIGS. 8A and 8F).

After the glass plate 1 has been produced, the silver mirror reaction is effectuated over the entire surface to film silver 3 (FIGS. 8B and 8G).

Subsequently, using a sponge silver is rubbed off so that silver remains in the patterned grooves (recessed portion) of the glass plate 1. Here, since the patterned grooves 2 are formed on the glass plate 1, silver 3 is allowed to remain only in the patterned grooves 2 of the orifice plate when silver residing on the surface is rubbed off (FIGS. 8C and 8H). In this respect, the surface of silver 3 is rough as shown in FIG. 8H.

Then, by use of the electroforming, nickel 4 is developed in a thickness of 10 $\mu$m on the portions where silver remain to make the nickel plating, and then, the gold 7 plating is made on the nickel 4 by used of electroforming so as to make it a coating member (FIGS. 8D and 8I).

Figure 8J:
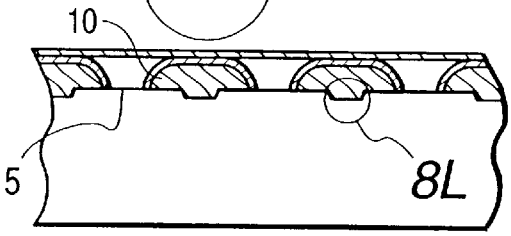

After that, the nickel 4 plated orifice plate 10 is peeled off from the glass plate 1 to complete the orifice plate 10 (FIGS. 8E and 8J). Here, at this juncture, the diameter of the discharge opening 5 thus formed is 16 $\mu$m±3%.

Now, the detailed description will be made of the method for plating nickel 4 and gold 7 as described above.

As the plating solution for nickel, nickel sulfamate is used together with an applied reducer, zeol (manufactured by the World Metal K.K.), boric acid, a pit inhibitor, NS-APS (manufactured by the World Metal K.K.), and nickel chloride. As the one for gold, potassium gold cyanide or potassium cyanide is used.

For the electrodeposition of nickel, the electric field is applied in such a manner that the electrodes are connected on the anode side in the plating solution, while the electrodes having silver 3 formed thereon are connected on the cathode side. The plating temperature is 50° C. The current density is 5 A/dm$^2$. Also, for the electrodeposition of gold, the electrodes are connected on the anode side in the plating solution, while the electrodes having nickel 4 formed on them are connected on the cathode side. The plating temperature is 65° C., and the current density is 4 A/dm$^2$.

In this respect, the portion indicated by slanted lines in FIG. 8C is the electrode unit to which the cathode is connected.

Figure 9:
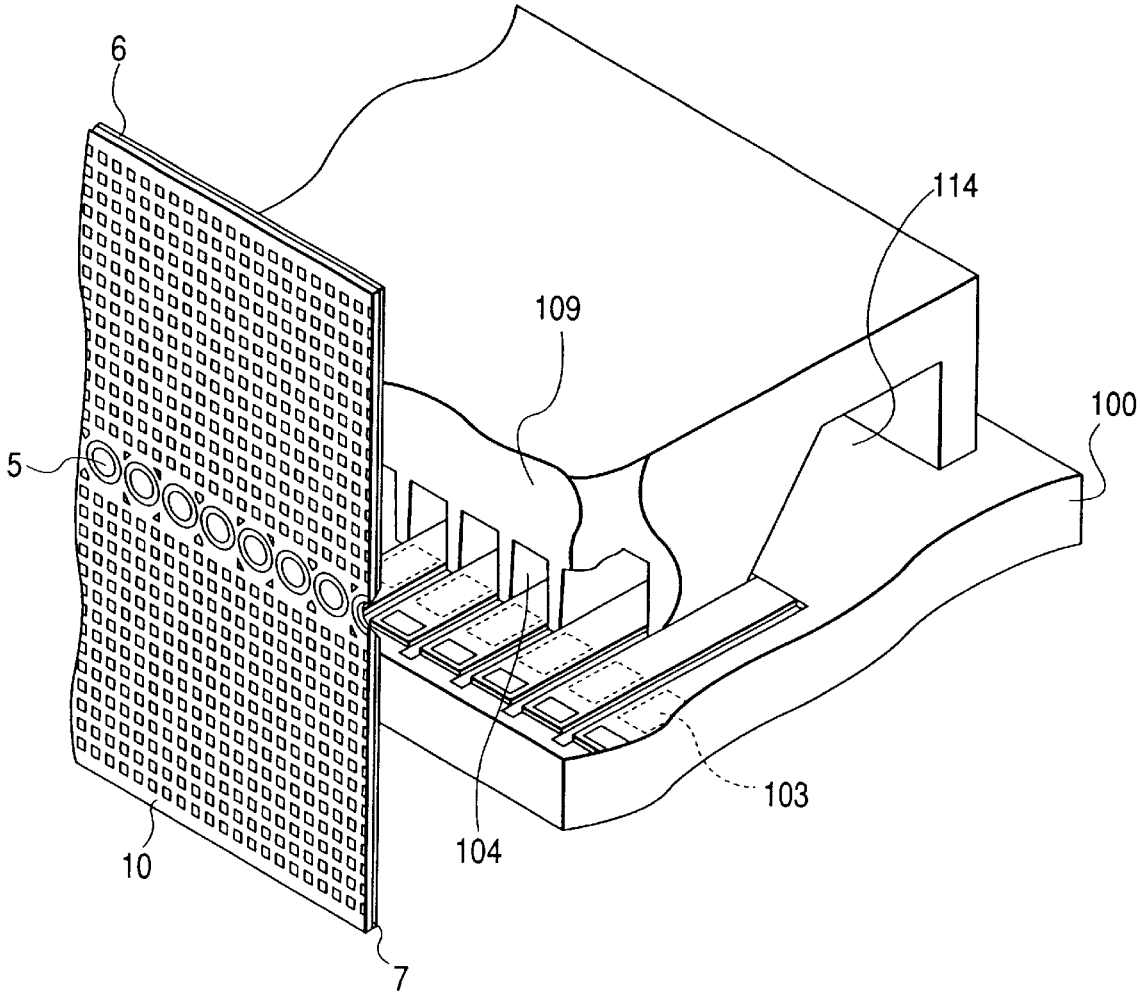
FIG. 9 is a view which shows one assembling step of the orifice plate, which is manufactured by the method represented in FIGS. 8A, 8B, 8C, 8D, 8E, 8F, 8G, 8H, 8I, 8J, 8K and 8L, to a liquid discharge.

FIG. 9 is a view which shows one assembling step of the orifice plate, which is manufactured by the method represented in FIGS. 8A to 8L, to a liquid discharge.

As shown in FIG. 9, bonding agent 6 is coated on the orifice plate 10. Then, the orifice plate 10 having the bonding agent 6 coated thereon is bonded to the face surface of the liquid discharge provided with the liquid flow paths 104, the elemental substrate 100, and the ceiling plate 109 formed therefor.

Figure 10A:
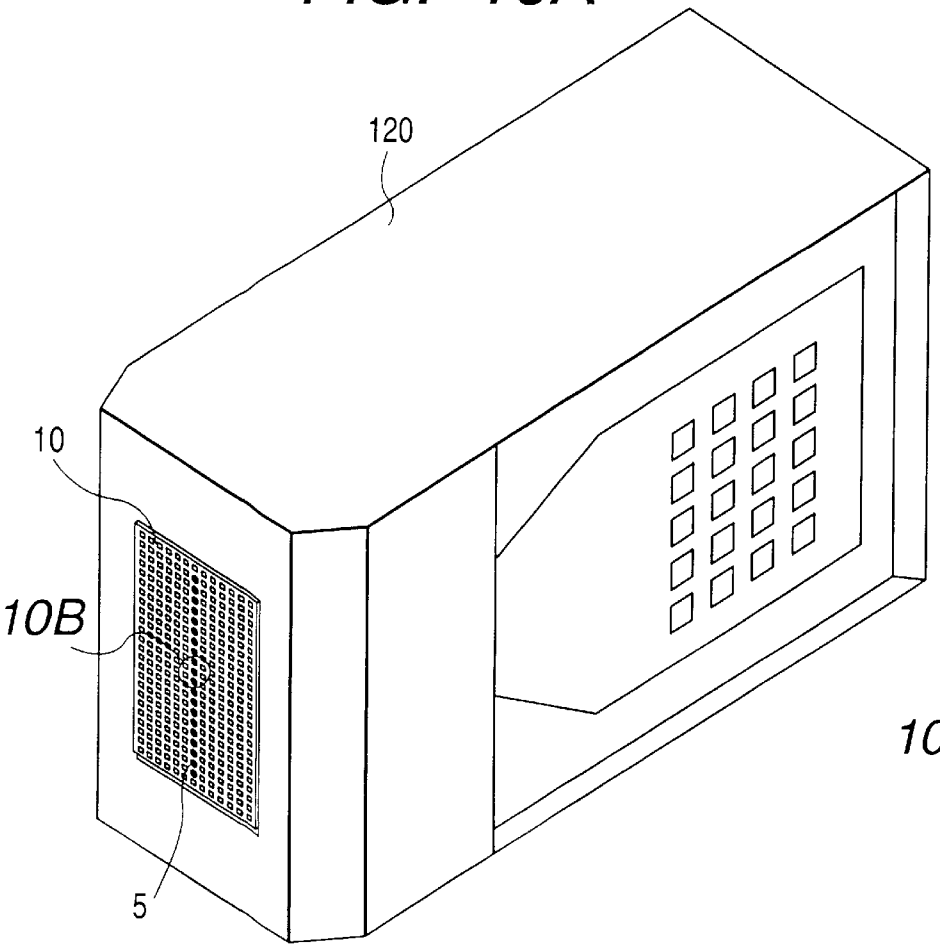
FIGS. 10A, 10B, 10C and 10D are views which illustrate the configuration of the liquid discharge provided with the orifice plate manufactured by the method represented in FIGS. 8A, 8B, 8C, 8D, 8E, 8F, 8G, 8H, 8I, 8J, 8K and 8L.
Figure 10B:
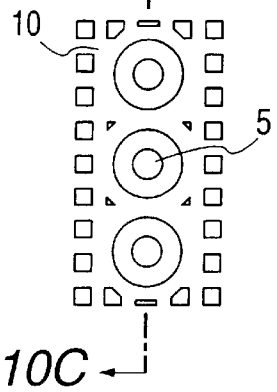
Figure 10C:
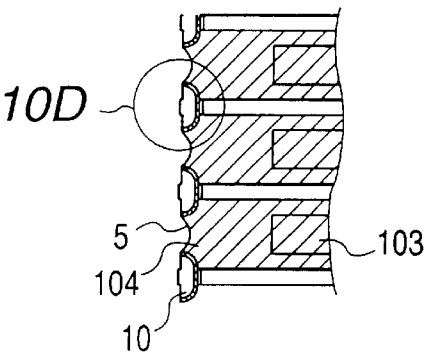
Figure 10D:
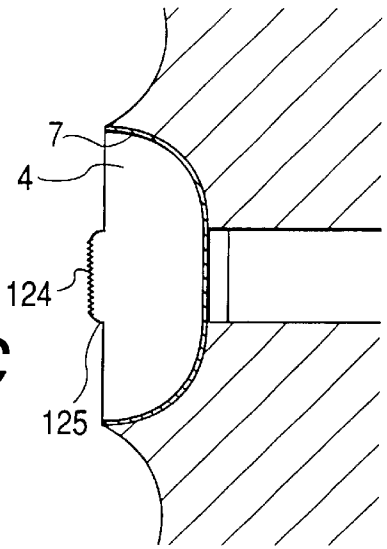

FIGS. 10A to 10D are views which illustrate the configuration of the liquid discharge provided with the orifice plate manufactured by the method represented in FIGS. 8A to 8L; FIG. 10A is a perspective view shows the external appearance thereof; FIG. 10B is a partially enlarged view which shows the portion 10B in FIG. 10A; FIG. 10C is a cross-sectional view, taken along line 10C—10C in FIG. 10B; FIG. 10D is a partially enlarged view which shows the portion 1D in FIG. 10C.

In the processing step shown in FIG. 9, the orifice plate 10 is bonded to the face surface of the liquid discharge. After that, the assembled body is incorporated in an ink cartridge 120. Thus, as shown in FIGS. 10A to 10D, the liquid discharge is completed.

Here, in accordance with the present embodiment, the edge of the pattern 124, having discharge port being formed in a specific position on the orifice plate as shown in FIG. 10D, becomes a rounded form as at 125 when the edge near the discharge port is lost at the time of distribution and in the initial stage of use. At the same time, the surface becomes irregular.

This formation is made when the face is wiped by the blade for removing dust particles and ink adhering to the face as well. Also, the adhesion of ink may corrode on the face to result in such formation.

In this way, it becomes possible to prevent the blade from being cut off by the sharp edged pattern of the face, and to prevent the blade from being deteriorated. Also, with the irregularities formed on the surface, the hydrophilic property of this portion becomes extremely higher than the other portions, thus making it possible to trap ink on them.

Also, the preservation test is carried out by use of ink, with the result that no cell reaction occurs to cause any corrosion on the orifice plate manufactured in accordance with the present embodiment. Also, in accordance with the present embodiment, gold 7 is used as the coating material. However, the present invention is not necessarily limited to it. If only the material to be used has a higher resistance to corrosion than the material used for the orifice plate formation (such as nickel used for the present embodiment).

(Embodiment 4)

For the embodiment described above, the description has been made of the example in which an orifice plate is applied to a head of the edge shooter type. However, the orifice plate is made applicable to a head of the side shooter type.

Figure 11:
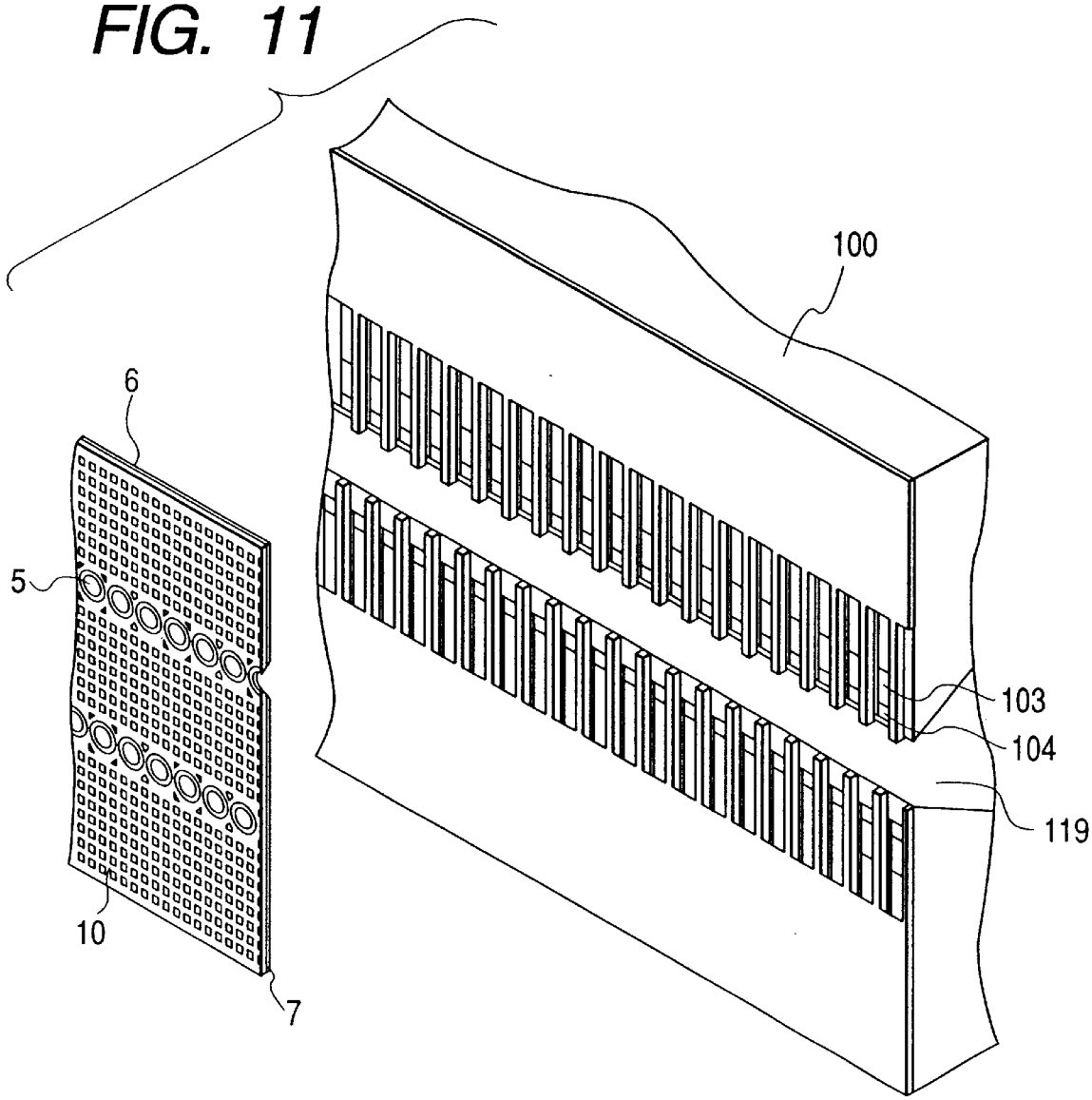
FIG. 11 is a view which shows one assembling step of the orifice plate, which is manufactured by the method represented in FIGS. 8A, 8B, 8C, 8D, 8E, 8F, 8C, 8H, 8I, 8J, 8K and 8L, to a liquid discharge of the side shooter type.

FIG. 11 is a view which shows one assembling step of the orifice plate, which is manufactured by the method represented in FIGS. 8A to 8L, to a liquid discharge of the side shooter type.

As shown in FIG. 11, the adhesive 6 is coated on the orifice plate 10. Then, the orifice plate 10 having the discharge port 5 arranged therefor is bonded to the liquid discharge provided with the liquid flow paths 104, the elemental substrate 100 provided with the heating member 103, and the ink supply path 119.

Then, after the orifice plate has been bonded to the liquid discharge, it is incorporated in an ink cartridge 120 as shown in FIG. 7, hence completing the liquid discharge.

Figure 12A:
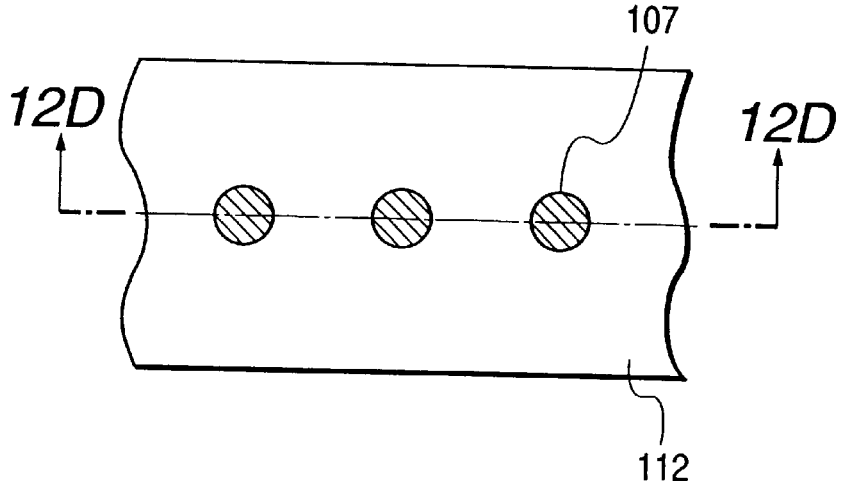
FIGS. 12A, 12B, 12C, 12D, 12E and 12F are views which illustrate one embodiment of the method for manufacturing an orifice plate in accordance with the present invention.
Figure 12B:
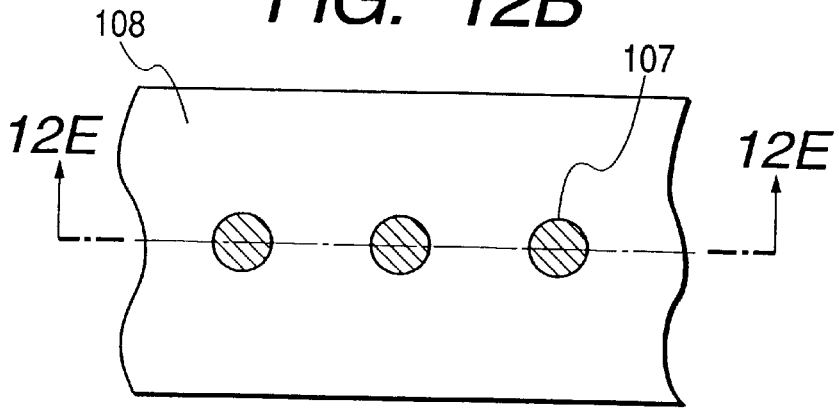
Figure 12C:
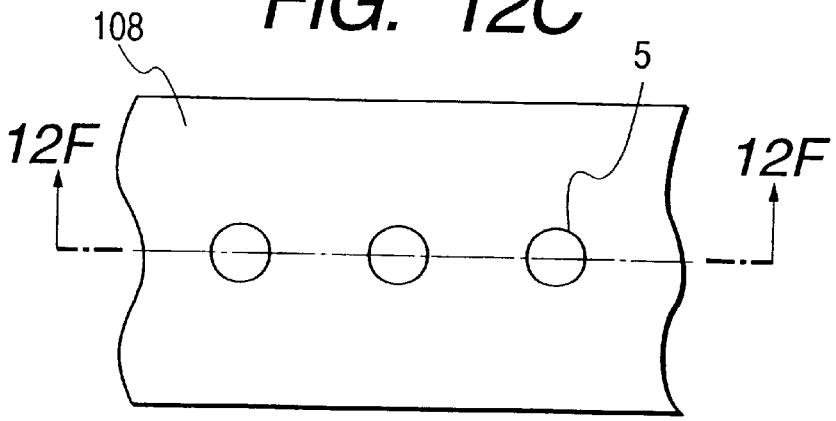
Figure 12D:
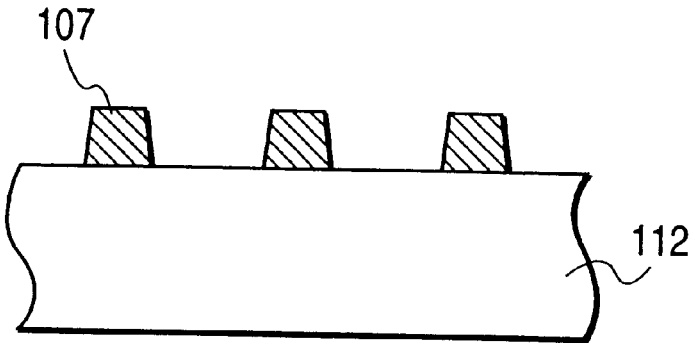
Figure 12E:
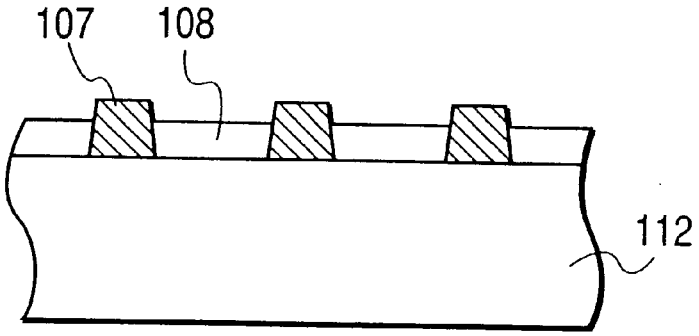
Figure 12F:
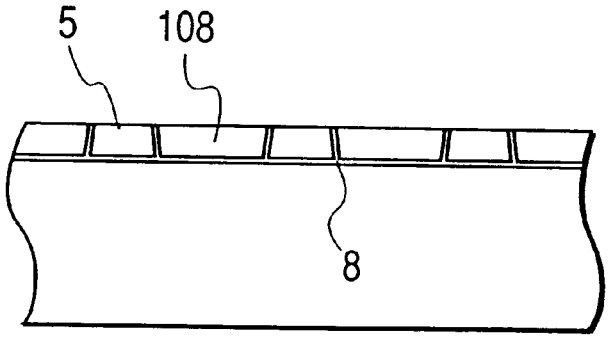

FIGS. 12A to 12F are views which illustrate one embodiment of the method for manufacturing an orifice plate in accordance with the present invention; FIGS. 12A to 12C are plan views; FIGS. 12D to 12F are cross-sectional views, taken along lines 12D—12D to 12F—12F, respectively.

Here, in accordance with the present embodiment, it is exemplified that resist 107 is patterned on a metallic matrix 112, and after nickel is plated, the orifice plate 108 formed by nickel is peeled off from the matrix 112, and then, a protection layer 8 is formed on the nickel surface on the matrix surface side.

At first, resist 107 is coated on the metallic (stainless) matrix 112, and patterning is carried out (FIG. 12A).

Then, nickel is plated to complete the orifice plate 108 formed by nickel (FIG. 12B).

Here, the plating is made in the same condition as in the method of manufacture represented in FIGS. 8A to 8L.

After that, the orifice plate 108 is peeled off from the matrix 112, and the protection layer 8 is formed on the matrix surface side of the orifice plate (FIG. 12C). Here, in accordance with the present embodiment, silicon nitride is formed in a thickness of one $\mu$m by use of the sputtering method. However, it may be possible to form an oxide film by use of the anode oxidation method or to form it by use of the application method.

Also, as the protection layer 8, an inorganic oxide, a metallic oxide film, an inorganic nitride, or the like, is conceivably usable. It is possible to use silicon oxide, tantalum oxide, nickel oxide, aluminum oxide, silicon nitride, platinum, gold, or the like.

Figure 13B:
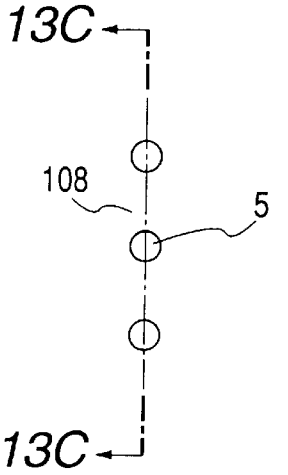
FIGS. 13A, 13B and 13C are views which illustrate the configuration of a liquid discharge provided with the orifice plate manufactured by the method represented in FIGS. 12A, 12B, 12C, 12D, 12E and 12F.
Figure 13C:
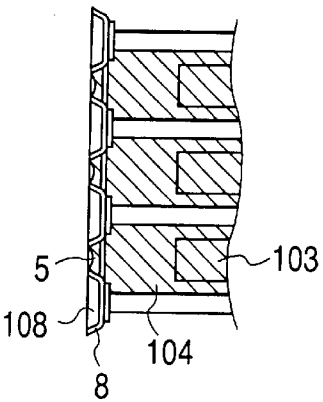
Figure 13A:
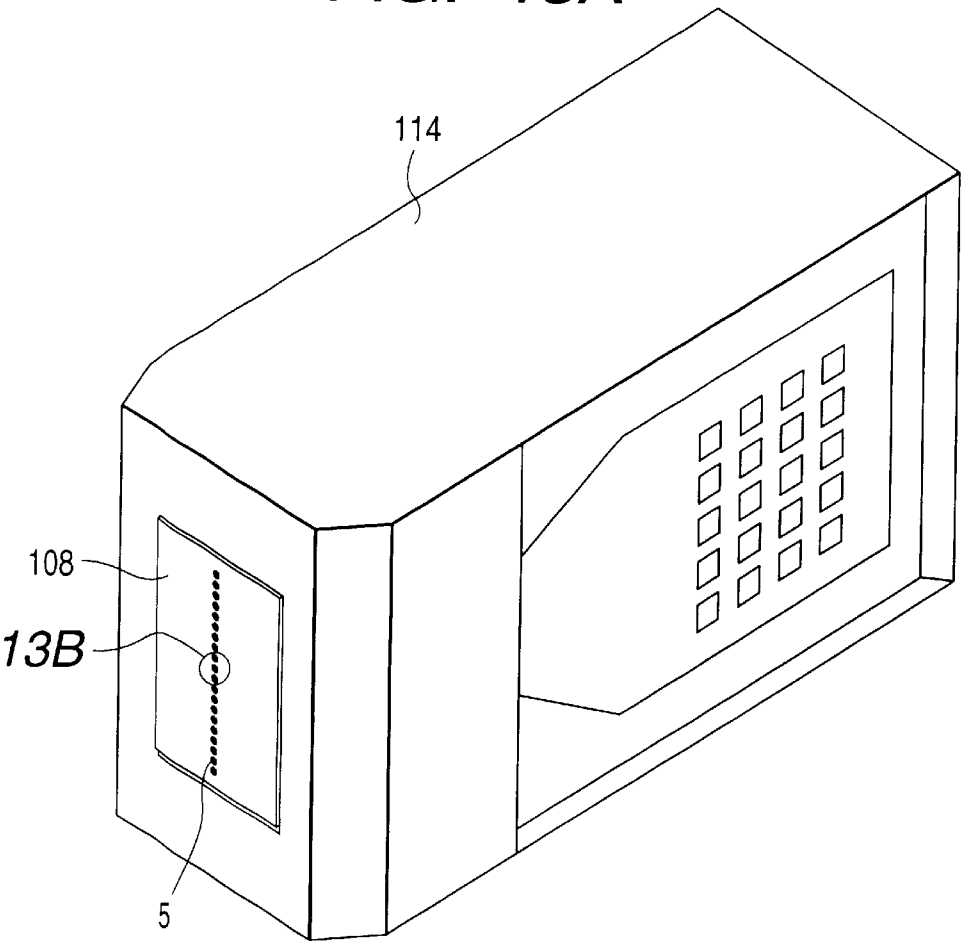
Figure 14:
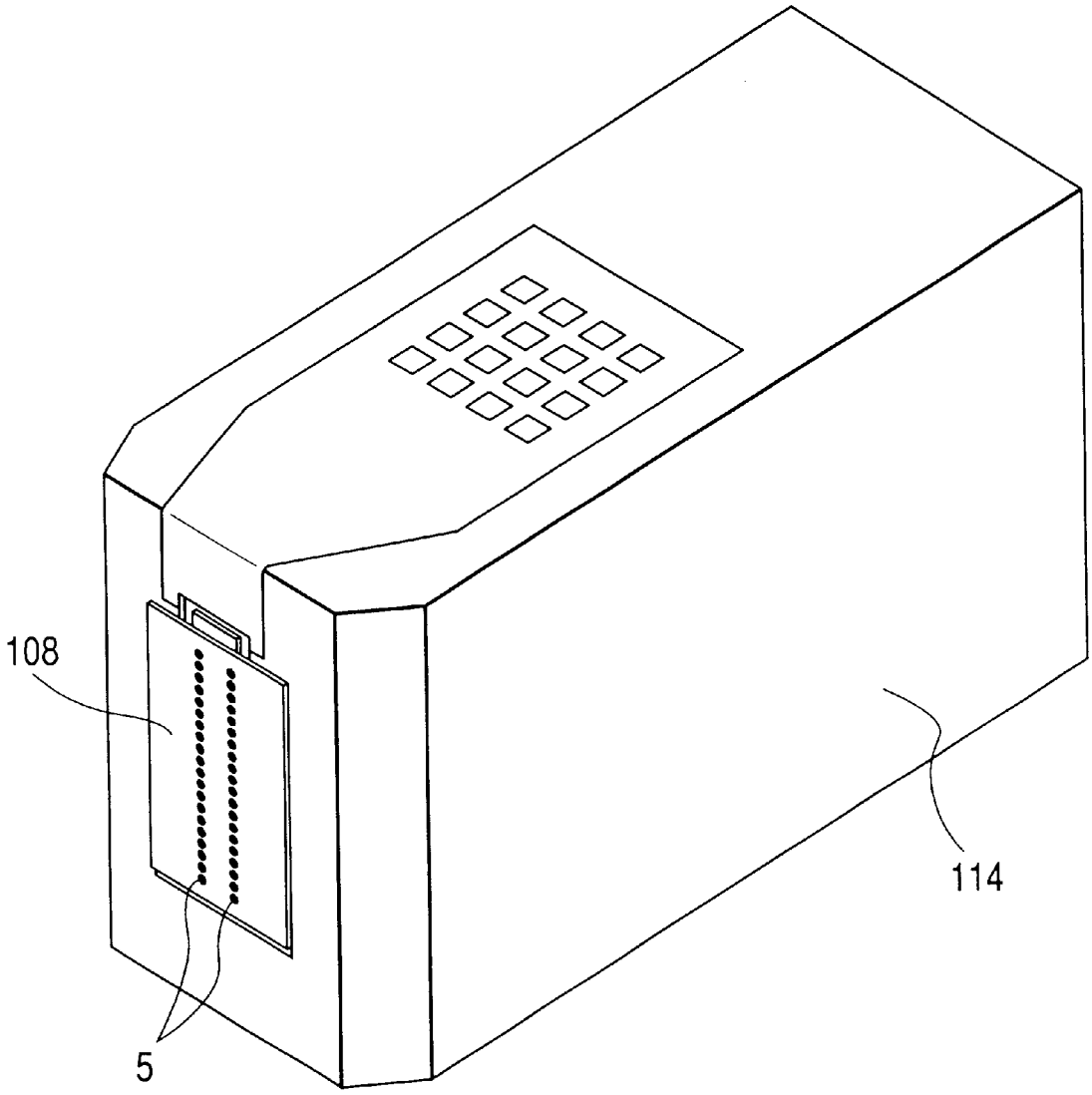
FIG. 14 is a view which shows the configuration of the side shooter type liquid discharge provided with the orifice plate manufactured by the method represented in FIGS. 12A, 12B, 12C, 12D, 12E and 12F.

After that, the completed orifice plate is assembled to a liquid discharge, hence completing the head of the edge shooter type as shown in FIGS. 13A to 13C or the head of the side shooter type as shown in FIG. 14.

In this respect, it may be possible to adopt a method in which the orifice plates thus produced are adhesively bonded to a wafer altogether. When metal is formed by plating, each of the orifice plates should be connected by use of leads if such method is adopted. A plurality of orifice plates are connected by leads and adhesively bonded to a highly smooth glass plate. As a result, it becomes possible to position the orifice plates and wafer (the elemental substrate provided with flow paths) altogether, hence the adhesive bonding being made at a time. After that, when cut off by use of dicing saw, the elemental substrate and orifice plate are completed each in a state of being connected.

Also, the orifice plate thus manufactured may be adhesively bonded to the substrate of pressure generating devices, which is provided with grooved flow paths. The orifice plate manufactured by the method of the present invention provides each of its hole diameters in good precision so as to make it usable for all the ink jet recording apparatus.

FIGS. 13A to 13C are views which illustrate the configuration of a liquid discharge provided with the orifice plate manufactured by the method represented in FIGS. 12A to 12F; FIG. 13A is a perspective view which shows the external appearance; FIG. 13B is a partially enlarged view which shows the portion 13B in FIG. 13A; and FIG. 13C is a cross-sectional view, taken along line 13C—13C. FIG. 14 is a view which shows the configuration of the side shooter type liquid discharge provided with the orifice plate manufactured by the method represented in FIGS. 12A to 12F.

For the present embodiment, too, the preservation test is carried out, with the result that no orifice plate is corroded by the cell structure, and there is no problem as to the reliability of the orifice plate at all.

Here, in accordance with the embodiment described above, the adhesive is coated on the orifice plate side when it is bonded to the liquid discharge. However, it may be possible to coat the adhesive on the face surface side with respect to the liquid discharge shown in FIG. 9 or on the elemental substrate 100 side with respect to the liquid discharge shown in FIG. 11. As the adhesive, the two-part adhesive which is an epoxy adhesive (CS-2340-5: manufactured by the Cemedain K.K.) or the polyether amide adhesive (HIMAL: manufactured by Hitachi Kasei K.K.) is used.

Also, for the material used for the electroforming in the processing steps in FIG. 8D and FIG. 12B, it is possible to use not only nickel, but also, to use the alloy of nickel and cobalt or the alloy of nickel and palladium. In this case, since the abrasion resistance of the orifice plate is made higher, the durability thereof is enhanced accordingly. Here, the material may be gold, platinum, or chromium.

Also, the ink container (not shown) provided for the interior of the liquid discharge shown in FIGS. 10A to 10D is arranged to be reusable by refilling ink when ink is consumed.

Now, hereunder, the description will be made of the liquid jet apparatus provided with the liquid discharge described above.

Figure 15:
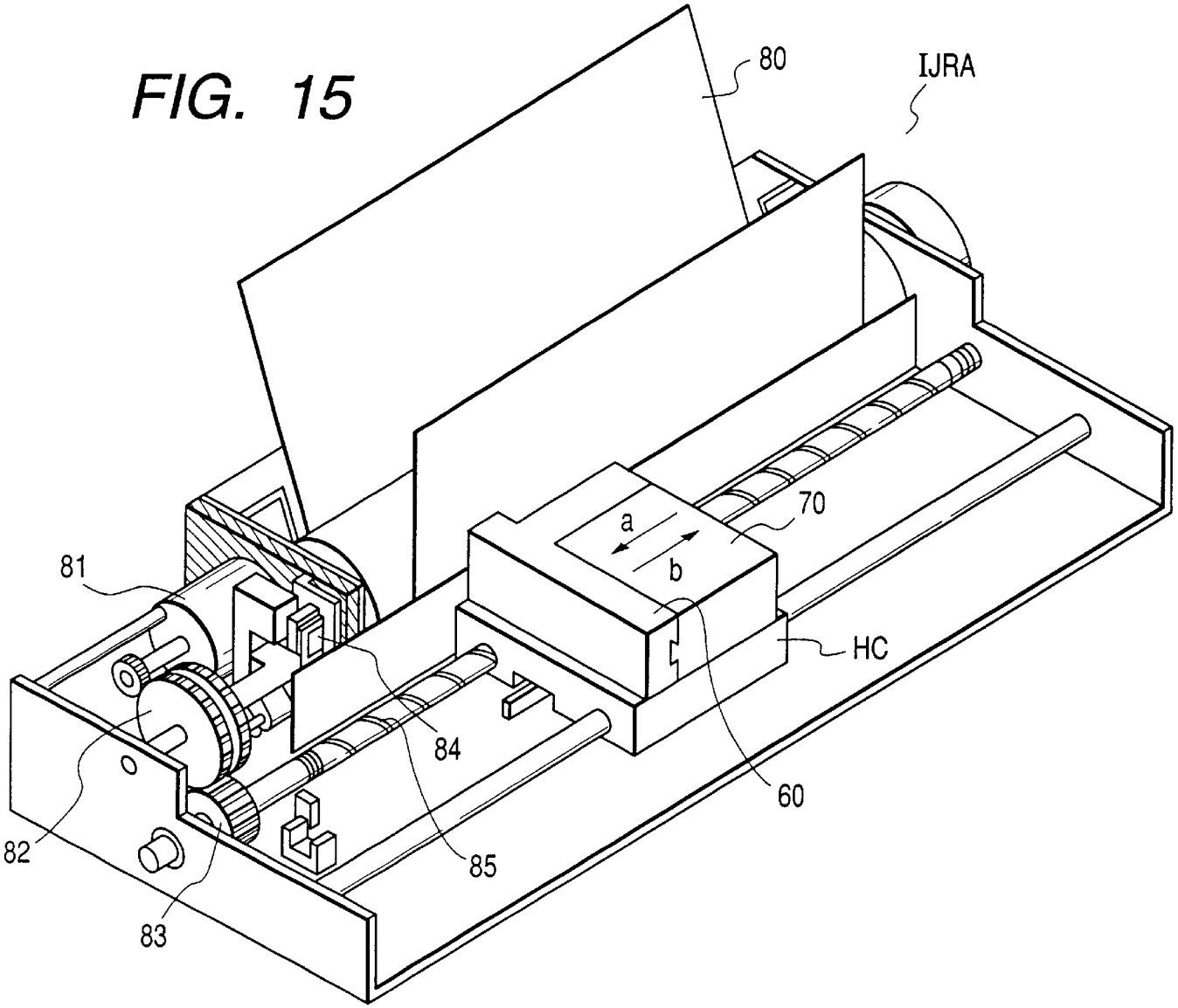
FIG. 15 is a view which shows one mode embodying the liquid jet apparatus having on it the liquid discharge manufacture in accordance with the present embodiment.

FIG. 15 is a view which shows one embodiment of the liquid jet apparatus (IJRA) having the liquid discharge mounted on it.

As shown in FIG. 15, in accordance with the present embodiment, it is arranged to mount on a carriage HC the head cartridge where a liquid tank unit 70 and a liquid discharge head unit 60 are detachably mountable. The carriage HC can reciprocate as indicated by arrows a and b in the width direction of a recording medium 80 which is carried by recording medium carrier means. When driving signals are supplied from driving signal supplying means (not shown) to the liquid discharge means on the carriage HC, ink or other liquid is discharged from the liquid discharge to the recording medium in accordance with such signals.

Also, for the liquid jet apparatus of the present embodiment, there are provided a motor 81 serving as the driving source to drive the recording medium carrier means and the carriage HC as well; the gears 82 and 83 that transmit the driving power from the driving source to the carriage HC; and the carriage shaft 85, among some others.

Figure 16:
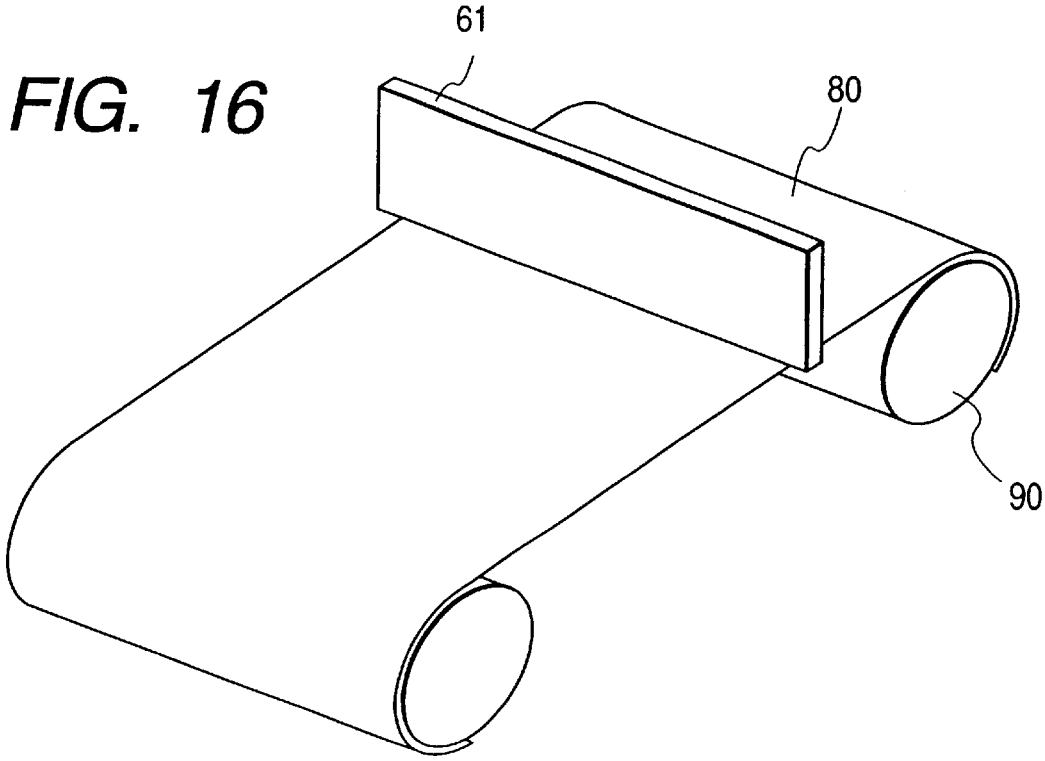
FIG. 16 is a view which schematically shows the so-called full line head and the apparatus thereof, in which a plurality of discharge port are arranged over the entire recordable area of a recording medium.
Figure 17A:
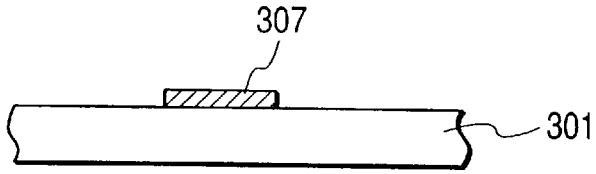
FIGS. 17A, 17B and 17C are views which illustrate the conventional method for manufacturing an orifice plate.
Figure 17B:
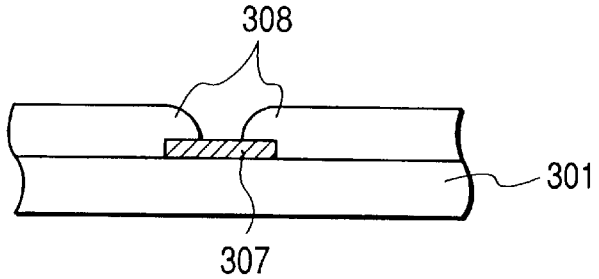
Figure 17C:
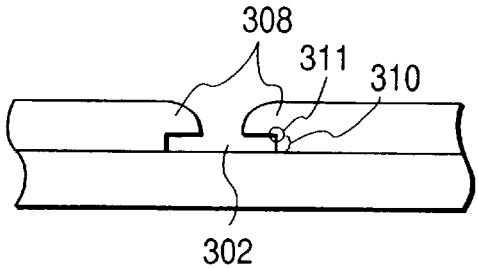

FIG. 16 is a view which schematically shows the full line head and its apparatus where a plurality of discharge ports are arranged over the recordable area of a recording medium.

As shown in FIG. 16, the full line head 61 of the present embodiment is arranged in a position shiftable to the recording medium 80. Also, the carrier drum 90 is provided as means for carrying the recording medium.

Here, in accordance with the present invention, it is of course possible to make each of the liquid discharges and liquid jet apparatuses of the present invention applicable to any one of ink discharge methods, ink jet recording heads, and ink jet recording apparatuses, respectively, by use of recording ink serving as liquid to be discharged, not necessarily limited to the embodiments described above.

As described above, in accordance with the present invention, the chromium which is electron-beam etched on the glass plate is used as the mask for patterning glass grooves. The glass grooves are plated with silver buried in them. Thus, the orifice plate is formed. As a result, it becomes possible to materialize the glass mask in the same precision as the one used for the photolithography. In this way, the variation of the orifice areas becomes smaller to make the formation of highly densified orifices possible.

Also, since the discharge port are formed without using resist, there is no possibility that any step is formed with respect to the discharge port. Therefore, it becomes possible to avoid any difficulty that may hinder the effectiveness of discharge energy acting upon discharging liquid droplets or to prevent the discharge directivity from being varied.

Also, the photolithographing steps are not adopted in order to manufacture orifice plates at lower costs. At the same time, there is no optical interference that may result in the elliptical configuration of each discharge port. Further, there is no resist wall present when plating is made. As a result, the sectional configuration of the discharge port presents the rounded form to make it easier to hold meniscus for the implementation of more stabilized liquid discharges and the enhancement of refilling capability as well.

Also, the chromium electron-beam etched on the glass plate is used as mask to pattern the glass grooves. Then, after the glass grooves are nickel plated with silver being buried in them, the nickel is further plated with a coating material having a higher resistant to corrosion than the nickel. As a result, even if silicon or metal is used for the elemental substrate having heater members formed thereon and the ceiling plate having flow paths formed, there is no possibility that the orifice plate is dissolved due to the formation of the cell structure.

In this way, even if the electroforming method is adopted, it is possible to stabilize the droplet discharges and materialize the provision of high quality images.

Also, the resist pattern is formed on the matrix, and after being nickel plated, the nickel is peeled off from the matrix. Then, on the surface on the matrix side, the protection layer is formed with the material having a higher resistance to corrosion than the nickel. In this case, too, it is possible to obtain the same effect as described above.

What is claimed is:

1. A method for manufacturing an orifice plate used for a liquid discharge provided with a discharge port for discharging liquid, comprising the following steps of:

preparing a non-conductive plate having a recessed portion formed on the circumference of a flat portion corresponding to said discharge port;

forming a first conductive material peelable from said non-conductive plate only in the recessed portion of said non-conductive plate;

forming a plate member by plating said first conductive material with a second conductive material by electroforming method after the formation of said first conductive material; and obtaining the orifice plate having said discharge port by peeling off said plate member from said non-conductive plate.

2. A method for manufacturing an orifice plate according to claim 1, wherein said non-conductive plate is a glass plate.

3. A method for manufacturing an orifice plate according to claim 1, wherein said first conductive material is silver.

4. A method for manufacturing an orifice plate according to claim 1, wherein said second material is either one of the alloy of nickel and cobalt, the alloy of nickel and palladium, gold, palladium, platinum, and chromium.

5. A method for manufacturing an orifice plate according to claim 3, wherein said step of forming said first conductive material on the non-conductive plate is to film silver on the entire surface of the non-conductive plate having said recessed portion formed thereon, and then, to rub off silver to remain silver only in the recessed portion of the non-conductive plate having said silver filmed thereon.

6. A method for manufacturing an orifice plate according to claim 1, wherein said metal is nickel.

7. A method for manufacturing an orifice plate according to claim 5, wherein said step of filming silver uses the silver mirror reaction.

8. A method for manufacturing an orifice plate according to claim 5, wherein said step of rubbing off silver uses a sponge.

9. A method for manufacturing an orifice plate according to claim 6, further comprising the step of:

plating a third conductive material having a higher resistance to corrosion than nickel by the electroforming method on said plate member before peeling off said plate member from the non-conductive plate.

10. A method for manufacturing an orifice plate according to claim 3, wherein said step of forming the first conductive material on the non-conductive plate is to film silver becoming the first conductive material on the entire surface of the non-conductive plate having said recessed portion formed thereon, and then, to rub off silver to remain silver only in said recessed portion of the non-conductive plate having said silver filmed thereon.

11. A method for manufacturing an orifice plate according to claim 9, wherein said third conductive material is either one of the alloy of nickel and cobalt, the alloy of nickel and palladium, gold, palladium, platinum, and chromium.

12. A method for manufacturing an orifice plate according to claim 10, wherein said step of filming silver uses the silver mirror reaction.

13. A method for manufacturing an orifice plate according to claim 10, wherein said step of rubbing off silver uses a sponge.

14. A method for manufacturing an orifice plate according to claim 1, wherein said non-conductive plate is used repeatedly.

15. An orifice plate used for a liquid discharge provided with discharge port for discharging liquid and formed by nickel, a protection layer having a higher resistance to corrosion than nickel being provided for the surface of said orifice plate on the ink discharge side.

16. An orifice plate according to claim 15, wherein said protection layer is formed by inorganic oxide, metallic oxide, or inorganic nitride.

17. An orifice plate according to claim 15, wherein said protection layer is either one of the alloy of nickel and cobalt, the alloy of nickel and palladium, gold, palladium, platinum, and chromium.

18. An orifice plate according to claim 16, wherein said protection layer is either one of silicon oxide, tantalum oxide, nickel oxide, aluminum oxide, silicon nitride.

19. A liquid discharge comprising:

an orifice plate according to claim 15;

a discharge port for discharging liquid;

a liquid flow path in communication with said discharge port; and an energy generating element arranged corresponding to said liquid flow path to generate energy to be utilized for discharging liquid.

20. A liquid discharge according to claim 19, wherein said orifice plate is bonded to the head main body by means of an adhesive.

21. A liquid discharge according to claim 19, wherein said adhesive is an epoxy adhesive.

22. A liquid discharge according to claim 19, wherein said adhesive is a polyether amide adhesive.

23. A liquid discharge according to claim 19, wherein said liquid discharge is the edge shooter type.

24. A liquid discharge according to claim 19, said liquid discharge is the side shooter type.

25. A method for manufacturing a liquid discharge provided with a plurality of discharge ports for discharging liquid, an orifice plate provided with said discharge port, a plurality of liquid flow paths in communication with said discharge port, a plurality of energy generating devices arranged corresponding to said liquid flow path to generate energy to be utilized for discharging liquid, and a substrate provided with said energy generating elements, comprising the following steps of:

preparing a non-conductive plate having a recessed portion formed on the circumference of a flat portion corresponding to said discharge port;

forming a first conductive material peelable from said non-conductive plate only in the recessed portion of said non-conductive plate;

forming a plate member becoming an orifice plate by plating said first conductive material with a second conductive material by electroforming method after the formation of said first conductive material;

positioning said substrate having a groove thereon to become said liquid flow paths with said plate member to bond them together; and peeling off the bonded body of said plate member and said substrate from said non-conductive plate.

26. A method for manufacturing a liquid discharge according to claim 25, wherein a plurality of liquid discharges are obtained by cutting said bonded body.

27. A method for manufacturing a liquid discharge according to claim 25, wherein said liquid discharge is the side shooter type.

* * * * *

UNITED STATES PATENT AND TRADEMARK OFFICE

CERTIFICATE OF CORRECTION

PATENT NO. : 6,328,420 B1
DATED : December 11, 2001
INVENTOR(S) : Koyama, Shuji et al.

It is certified that error appears in the above-identified patent and that said Letters Patent is hereby corrected as shown below:

Title page,
Item [56], References Cited, FOREIGN PATENT DOCUMENTS, "11238733" should read -- 11-238733 --; and "11348289" should read -- 11-348289 --.

Item [57], ABSTRACT,
Line 2, "with" should read -- with a --.

Column 1,
Line 19, "a" should be deleted;
Line 19, "with" should read -- with a --;
Line 21, "It" should read -- It is --;
Line 23, "comlexly" should read -- complexly --
Line 42, "use" should read -- uses --; and
Line 59, "a" (third occurrence) should be deleted.

Column 2,
Line 1, "are" should read -- is --; and
Line 36, "are" should read -- is --.

Column 3,
Line 59, "having" should read -- having a --; and
Line 65, "port" should read -- ports --.

Column 4,
Line 29, "are" should read -- is --.

Column 5,
Line 34, "views" should read -- view --.

Column 6,
Line 66, "remain" should read -- remains --.

UNITED STATES PATENT AND TRADEMARK OFFICE

CERTIFICATE OF CORRECTION

PATENT NO. : 6,328,420 B1
DATED : December 11, 2001
INVENTOR(S) : Koyama, Shuji et al.

It is certified that error appears in the above-identified patent and that said Letters Patent is hereby corrected as shown below:

Column 9,
Line 13, "remain" should read -- remains --;
Line 15, "used" should read -- use --; and
Line 54, "view" should read -- view which --.

Signed and Sealed this

Twenty-third Day of April, 2002

*Attest:*

*Attesting Officer*

JAMES E. ROGAN
*Director of the United States Patent and Trademark Office*